US008646373B1

(12) United States Patent
Kucherov et al.

(10) Patent No.: US 8,646,373 B1
(45) Date of Patent: Feb. 11, 2014

(54) BLAST WAVE EFFECTS REDUCTION SYSTEM

(75) Inventors: Yan R. Kucherov, Alexandria, VA (US); Graham K. Hubler, Highland, MD (US)

(73) Assignee: Nova Research, Inc., Alexandria, VA (US)

( * ) Notice: Subject to any disclaimer, the term of this patent is extended or adjusted under 35 U.S.C. 154(b) by 440 days.

(21) Appl. No.: 12/454,495

(22) Filed: May 4, 2009

(51) Int. Cl.
*H01Q 19/185* (2006.01)
*H01Q 19/19* (2006.01)

(52) U.S. Cl.
USPC ..... 89/36.11; 89/938; 342/2; 342/3; 342/4

(58) Field of Classification Search
USPC ..... 89/36.02, 903, 904, 910, 911, 920, 923, 89/36.11, 938, 939, 36.17, 902; 86/50; 244/121; 342/2, 3, 4
See application file for complete search history.

(56) References Cited

U.S. PATENT DOCUMENTS

| | | | | |
|---|---|---|---|---|
| 2,959,916 | A | 11/1960 | Carlton et al. | |
| 3,008,291 | A | 11/1961 | Hardgrave, Jr. | |
| 3,592,147 | A | 7/1971 | Harper | |
| 3,636,895 | A * | 1/1972 | Kelsey | 109/78 |
| 3,680,814 | A | 8/1972 | Geary | |
| 3,709,446 | A | 1/1973 | Espy | |
| 4,104,002 | A | 8/1978 | Ehrich | |
| 4,789,117 | A | 12/1988 | Paterson et al. | |
| 5,150,122 | A * | 9/1992 | Bell | 342/8 |
| 5,263,661 | A | 11/1993 | Riley | |
| 5,598,990 | A | 2/1997 | Farokhi et al. | |
| 5,622,753 | A | 4/1997 | Shepley et al. | |
| 5,905,225 | A * | 5/1999 | Joynt | 89/36.02 |
| 5,946,719 | A * | 9/1999 | Crupi et al. | 2/6.5 |
| 6,108,825 | A * | 8/2000 | Bell et al. | 2/455 |
| 6,148,937 | A * | 11/2000 | Mensa-Wilmot et al. | 175/428 |
| 6,200,664 | B1 | 3/2001 | Figge et al. | |
| 6,698,684 | B1 | 3/2004 | Henne et al. | |
| 6,854,687 | B1 | 2/2005 | Morgenstern et al. | |
| 6,880,476 | B2 | 4/2005 | Olsen et al. | |
| 7,017,705 | B2 | 3/2006 | Ponomarev et al. | |
| 7,048,229 | B2 | 5/2006 | Sanders et al. | |

(Continued)

FOREIGN PATENT DOCUMENTS

| | | |
|---|---|---|
| GB | 8439 | 0/1913 |
| RU | 2 153 591 | 7/2000 |
| WO | WO 01/58754 | 8/2001 |

OTHER PUBLICATIONS

International Search Report and Written Opinion issued in PCT Application No. PCTUS2010/28899, issued on Sep 1, 2010.

(Continued)

*Primary Examiner* — Stephen M Johnson
(74) *Attorney, Agent, or Firm* — Workman Nydegger

(57) ABSTRACT

A system for reducing the effects of a blast wave includes armor plating configured to face a supersonic blast wave. The armor plating has a surface consisting of alternating tall and short peaks with valleys between the peaks. The peaks and valleys are positioned such that the supersonic blast wave reflects from the side surfaces of the tall peaks as a regular reflection that at least partially suppresses Mach reflection of the supersonic wave caused by the short peaks and the valleys. The surface may also be designed to not trap reflected waves. The valleys can be parabolic shaped to deflect and/or dissipate transonic flow that follows the blast wave front.

22 Claims, 16 Drawing Sheets

(56) References Cited

U.S. PATENT DOCUMENTS

| | | | | |
|---|---|---|---|---|
| 7,114,685 | B1 | 10/2006 | Schulein | |
| 7,866,248 | B2 * | 1/2011 | Moore et al. | 89/36.02 |
| 8,030,228 | B2 * | 10/2011 | Flavin | 442/132 |
| 2006/0042115 | A1 | 3/2006 | Karr et al. | |
| 2007/0243068 | A1 | 10/2007 | Wadia et al. | |
| 2008/0264243 | A1 * | 10/2008 | Lucuta et al. | 89/36.02 |
| 2009/0272254 | A1 * | 11/2009 | Hunn et al. | 89/36.02 |
| 2010/0212484 | A1 * | 8/2010 | Williams et al. | 89/36.02 |
| 2010/0307327 | A1 * | 12/2010 | Gettle | 89/36.02 |

OTHER PUBLICATIONS

Landers, et al. *F-16XL Wing Pressure Distributions and Shock Fence Results form Mach 1.4 to Mach 2.0*, National Aeronautics and Space Administration, Oct. 1997, 44 pages.

Casalino et al., *Aircraft noise reduction technologies: A bibliographic review*, Aerospace Science and Techology, vol. 12, Iss. 1, Jan. 2008, pp. 1-17.

Ueda et al. *Supersonic Flutter of Truncated Conical Shells*, Transactions of the Japan Society for Aeronautical and Space Sciences, vol. 20, Iss. 47, Apr. 1977, pp. 13-30.

Beric. W. Skews et al., *The Physical Nature of Weak Shock Wave Reflection*, Journal of Fluid Mechanics, 2005, vol. 542, pp. 105-114.

D.V. Khotoyanovsky et al., *Effects of a Single-Pulse Energy Deposition on Steady Shock Wave Reflection*, Shock Waves, 2006, vol. 15, pp. 353-362.

M.S. Ivanov et al., *Experiments on Shock Wave Reflection Transition and Hysteresis in Low-Noise Wind Tunnel*, Physics of Fluids, 2003, vol. 15, No. 6, pp. 1807-1810.

H. Kleine et al., *High-Speed Time-Resolved Color Schlieren Visualization of Shock Wave Phenomena*, Shock Waves, 2005, vol. 14, pp. 333-341.

G. Ben-Dor, *Pseudo-Steady Shock Wave Reflections: A State-of-the Knowledge Review*, Pearlstone Center for Aeronautical Engineering Strudies, Department of Mechanical Engineering, Ben-Gurion University of the Negev, pp. 1-11, at least before Jun. 5, 2008.

* cited by examiner

BLAST WAVE EFFECTS REDUCTION SYSTEM

GOVERNMENT LICENSE RIGHTS

The U.S. Government has a paid-up license in this invention and the right in limited circumstances to require the patent owner to license others on reasonable terms as provided for by the terms of contract No. N00173-07-C-2055 awarded by U.S. Naval Research Laboratory.

CROSS-REFERENCE TO RELATED APPLICATIONS

Not applicable.

BACKGROUND OF THE INVENTION

1. The Field of the Invention

The invention relates to blast wave absorption systems and more specifically to blast wave absorption systems that effectively suppress Mach reflections of a supersonic blast wave.

2. The Relevant Technology

When a bomb or other explosive device is detonated, the area around the explosion becomes overpressurized, resulting in highly compressed air particles that travel outward from the explosion at a high rate of speed, thereby forming a blast wave. This blast wave will dissipate over time and distance and will exist generally only for a matter of milliseconds at any one distance from the explosion. However, in that short amount of time the blast wave can create a tremendous amount of force against anything with which it comes in contact, typically causing a great deal of damage. Furthermore, a transonic flow can follow the shock wave front, which causes a secondary force that can also cause damage.

The faster a blast wave propagates the more damage it potentially can inflict. At the speed of sound in the air (Mach (M)=1 or approximately 330 m/s) the equivalent excess pressure caused by the blast wave is close to 0.6 bars. This pressure is dangerous for most buildings, but typically not sufficient to damage an armored vehicle. At larger blast wave velocities (i.e., at supersonic speeds (M>1)), however, the waves become damaging to practically any man-made structure.

To protect against such a blast wave, devices have been designed to absorb the energy caused by these blast waves. Some typical areas where the energy absorbing devices have been used include explosive ordnance disposal (EOD) suits, vehicle armor, supersonic aircraft engine linings, and building protection. One feature that is common to these current designs is the use of energy absorbing elements. One example of a current use of an energy absorbing element is a blast door. The typical blast door is suspended on springs so that the springs can absorb the impact energy when the blast wave hits the door. Another example is chalk panels, which fracture on impact and friction between the particles absorbs energy. Another energy absorbing scheme is described in U.S. Pat. No. 6,200,664, where energy is absorbed by liquid contained within collapsible structures. Still another example is described in U.S. Pat. No. 7,017,705, which deals with incident and reflected waves by incorporating an evacuated layer in a wave-absorbing device.

While energy absorbing devices have been effective for blast waves traveling at lower velocities, they have not been able to withstand the higher velocity blast waves. What is needed in the art, therefore, are systems that can increase dissipation or deflection of the higher velocity blast waves, with or without the use of energy absorbing materials or devices.

BRIEF DESCRIPTION OF THE DRAWINGS

Various embodiments of the present invention will now be discussed with reference to the appended drawings. It is appreciated that these drawings depict only typical embodiments of the invention and are therefore not to be considered limiting of its scope.

DETAILED DESCRIPTION OF THE PREFERRED EMBODIMENTS

The present invention relates to blast wave absorption systems capable of dissipating or deflecting blast wave energy due to the shape of the surface of armor plating associated therewith. More specifically, the embodiments described herein have armor plating with surfaces that include peaks and valleys formed thereon in such a manner that much of the energy is deflected or otherwise dissipated.

A "shock wave" as used herein is defined as a region of abrupt change of pressure and density moving as a wave front at or above the velocity of sound, such as that caused by an intense explosion or supersonic flow over a body. A "blast wave" as used herein is a type of shock wave that is a violent propagating disturbance, produced by an explosion in air, that consists of an abrupt rise in pressure followed by a drop in pressure to or below atmospheric pressure. A blast wave can also be considered a single shock wave that propagates through a medium over time. That is, a blast wave as used herein does not refer to a steady state condition but to a one time "pulse." Although the discussion herein is directed to blast waves, it is appreciated that embodiments of the present invention can also be used with other types of shock waves, including steady state shock waves.

As noted above, when a bomb or other explosive device is detonated, a blast wave is generated that emanates out from the explosion at a high rate of speed. For large explosives this blast wave is typically supersonic. As is known in the art, when a supersonic flow or wave impinges on a wedge or at an angle to a flat wall, a reflection occurs. The type of reflection depends on the velocity of the flow or wave (also known as the Mach number M, where M=1 corresponds to the speed of sound in the medium) and the angle $\alpha$ between the wall or the wedge and the direction of the supersonic flow. There are three distinctive types of reflections caused by supersonic flows in gases (see, e.g., B. W. Skews, J. T. Ashworth, The Physical Nature of Weak Shock Wave Reflection, Journal of Fluid Mechanics, 2005, vol. 542, pp. 105-114). At small angles $\alpha$ and/or small Mach values M, regular reflections occur. At larger angles and Mach numbers, a connector is formed between incoming and reflecting supersonic flow called a Mach stem, and this type of reflection is called Mach reflection. Finally, in a very narrow range of Mach numbers, Von Neumann types of reflection exist, but will not be considered herein.

Figure 1:
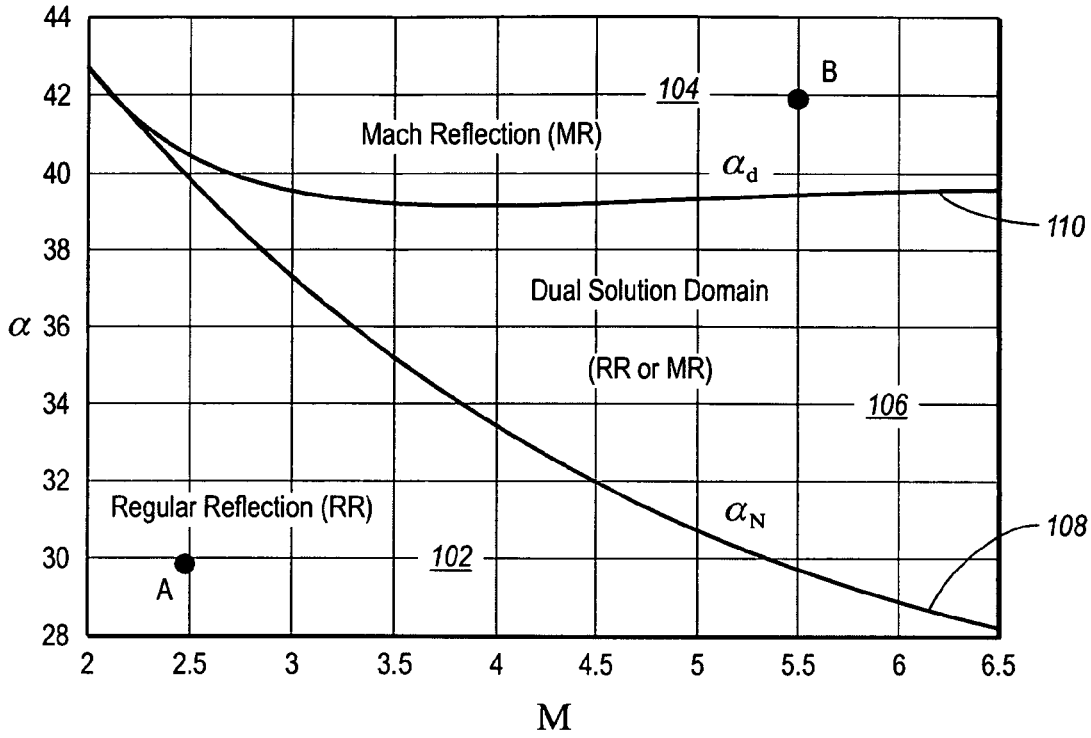
FIG. 1 is a graph showing the different regions in which Mach and regular reflections occur in relation to the incident angle and velocity of a shock wave.

An example of areas corresponding to regular and Mach reflection, and transition areas therebetween, is shown in the graph of FIG. 1, which is taken from D. V. Khotoyanovsky et al., Shock Waves, 2006, vol. 15, pp. 353-362. In FIG. 1, the x-axis of the graph represents the velocity of a supersonic flow (e.g., a blast wave), and the y-axis represents the angle between the wall or the wedge and the direction in which the flow is propagating. Area 102 of the graph corresponds to conditions at which regular reflections occur, area 104 corresponds to conditions at which Mach reflections occur, and area 106 corresponds to conditions at which regular and/or Mach reflections can occur. Transition lines 108 and 110 define the transitions between the aforementioned reflection areas.

For example, in a system corresponding to FIG. 1, if the velocity of the incident supersonic flow was 2.5 M and the angle $\alpha$ was 30 degrees (denoted by point A on FIG. 1), a regular reflection occurs. Regular reflections are discussed below in more detail. Conversely, if the Mach number M of the incident supersonic flow was 5.5 and the angle $\alpha$ was 42 degrees (denoted by point B on FIG. 1), a Mach reflection occurs. Mach reflections are also discussed below in more detail. It is noted that FIG. 1 is exemplary only and it is understood that the curves shown therein could correspond to different positions on the graph, depending on the type of medium used as well as other considerations, as is known in the art.

As can be seen from FIG. 1, transition lines 108 and 110 denote where the reflection transitions between regular and Mach reflections or where a combination of reflections occur. That is, if the wave incident angle $\alpha$ is changed for a given velocity M, a transition between regular and Mach reflection will occur at the transition angle corresponding to the velocity M. FIG. 1 illustrates dependence of the transition angle in the air on the Mach number. It is known from supersonic wind tunnel experiments (see, e.g., M. S. Ivanov et al, Physics of Fluids, 2003, vol. 15, No. 6, pp. 1807-1810), that transition from regular reflection on a target to Mach reflection results in an increased pressure drop in front of the target and a pressure drop behind it. This is equivalent to an increased pressure or force on the target. As such, it would be desirous to suppress Mach reflections that occur on the target to thereby reduce the force imposed on the structure by the occurrence of the Mach reflection. Another goal of the present invention is to organize the transonic flow following the shock front to further reduce the maximum force on the structure.

Figure 2:
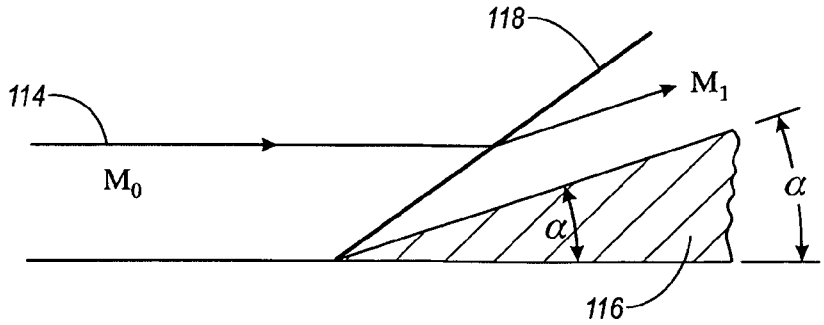
FIG. 2 is a side view of a wedge, showing how a regular reflection occurs from an incident shock wave.
Figure 3:
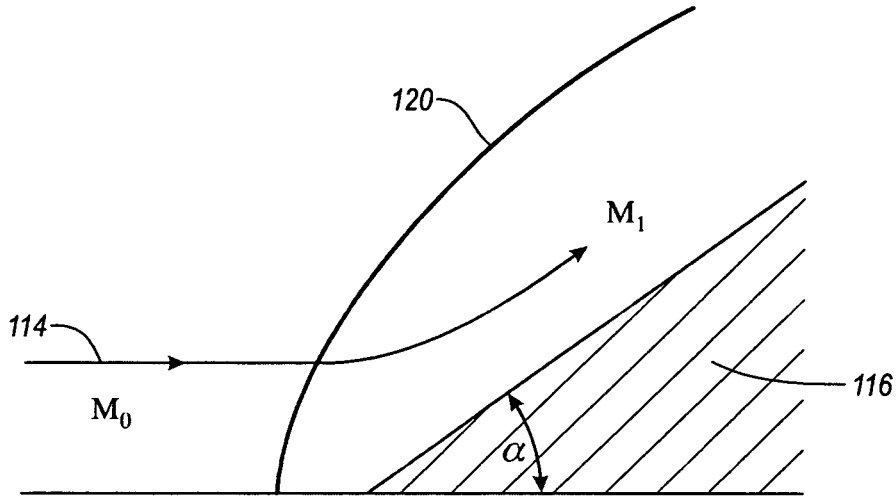
FIG. 3 is a side view of a wedge, showing how a Mach reflection occurs from an incident shock wave.

Regular and Mach reflections are known in the art. Because of this only a cursory, explanation of each will be given herein. Turning to FIGS. 2 and 3, when an incident supersonic flow 114, such as a steady state air flow or a blast wave pulse, moving in the direction denoted comes into contact with a wedge shaped structure 116, a reflection occurs. When the incident flow velocity $M_0$ and the incident angle $\alpha$ between the flow 114 and the wedge 116 are such that a regular reflection occurs (see, e.g., point A on FIG. 1), an attached shock wave 118 is formed on the wedge shaped structure, as shown in FIG. 2. In contrast, when the incident flow velocity $M_0$ and the incident angle $\alpha$ are such that a Mach reflection occurs (see, e.g., point B on FIG. 1), a detached shock wave 120 is formed in front of the wedge shaped structure, as shown in FIG. 3. As noted above and known in the art, the force acting against a structure caused by Mach reflection is typically much greater than the force caused by regular reflection and thus can cause more damage to the structure. Thus, it would be desirable to diminish Mach reflections.

Figure 4:
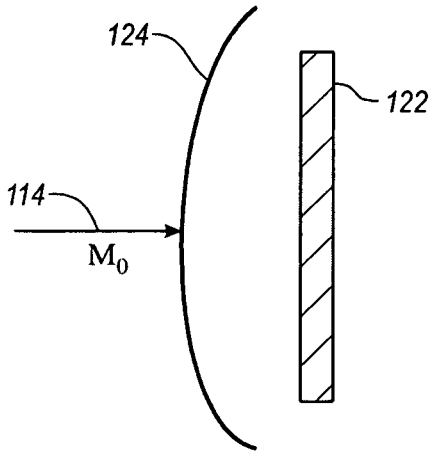
FIG. 4 is a side view of a flat blast panel, showing how a blast wave is reflected thereby.

As shown in FIG. 4, it is noted that when the incident supersonic flow 114, such as a steady state air flow or a blast wave pulse, encounters a generally flat blast panel 122 generally face on, a Mach reflection occurs with a detached shock wave 124 being formed in front of the blast panel 122. This Mach reflection occurs because the overall angle of the blast panel to the incident flow is roughly 90 degrees, or orthogonal. As a result of the Mach reflection, a large force is imparted to the blast panel 122.

Although not completely eliminating Mach reflections, embodiments of the present application minimize the amount of Mach reflection caused by the incident supersonic flow against the blast panel. Specifically, the surface profile is designed to reduce the overall Mach reflection of an incident supersonic flow by use of peaks and valleys formed thereon.

Figure 5:
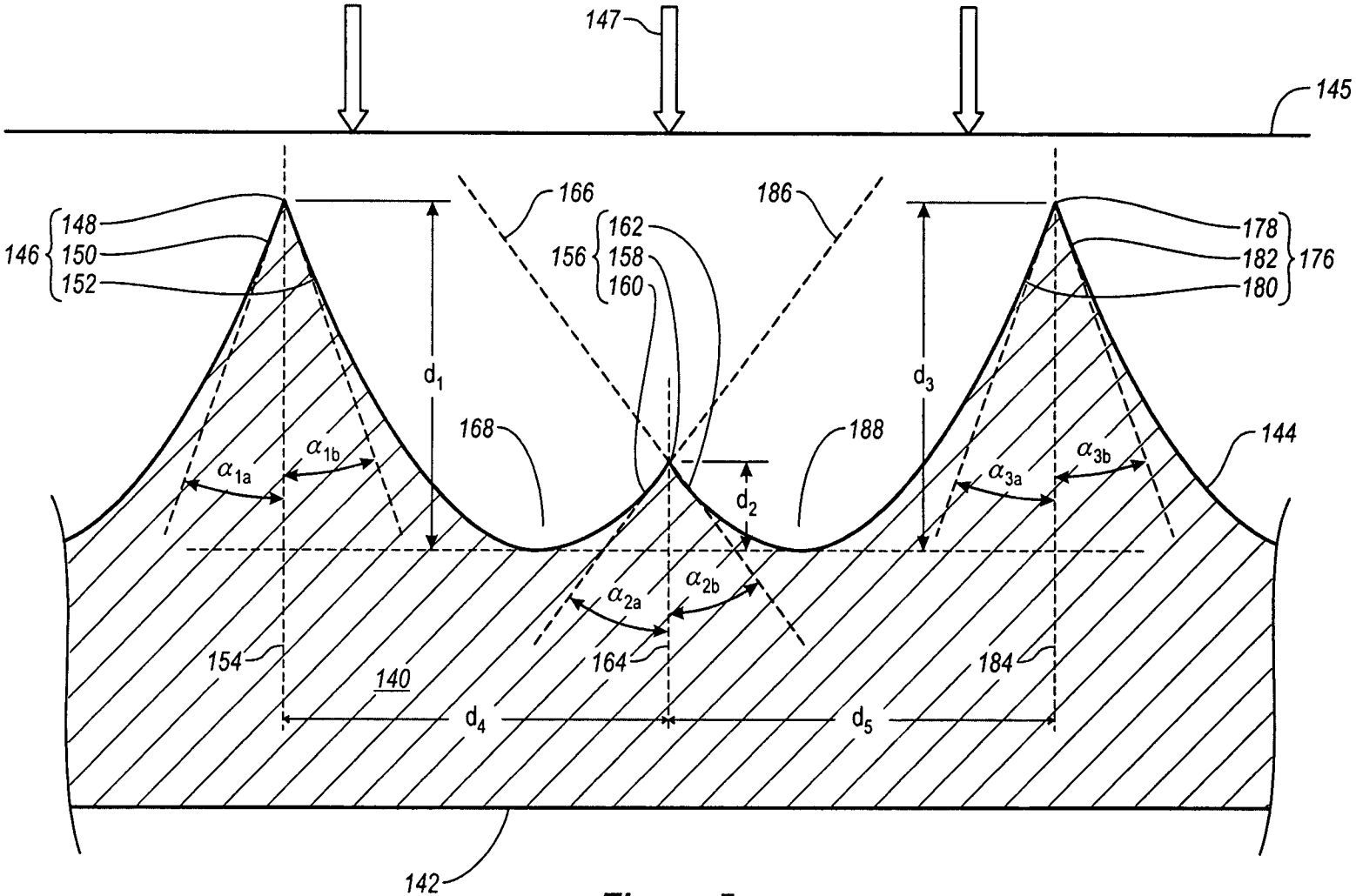
FIG. 5 is a cross-sectional view of a portion of a blast panel according to one embodiment of the present invention in which the valleys are continuously curved.

FIG. 5 depicts a portion of a surface profile of a blast panel 140 according to one embodiment of the present invention. Blast panel 140 comprises armor plating having an inner surface 142 and an opposing outer surface 144. Outer surface 144 is configured to face a supersonic blast wave 145 generated by a bomb, other explosive device or the like that is propagating toward the armor plating in the direction denoted by arrow 147. A series of peaks and valleys are formed in the outer surface 144 of the blast panel 140.

A first peak 146 is formed on outer surface 144. First peak 146 comprises two side surfaces 150 and 152 that both extend out to a first apex 148 on opposite sides of a longitudinal axis 154. In some embodiments, longitudinal axis 154 bisects the angle formed between side surfaces 150 and 152 at first apex 148. In some embodiments, longitudinal axis 154 is orthogonal to inner surface 142 of blast panel 140. In any event, longitudinal axis 154 is designed to be generally aligned with the propagation direction 147 of incident blast wave 145 when the portion of blast panel 140 that contains first peak 146 is "face on" to incident blast wave 145.

As depicted in the cross-sectional view of FIG. 5, the two side surfaces 150 and 152 are shaped so that the first peak 146 has a substantially triangular cross-section near first apex 148. Side surfaces 150 and 152 form angles $\alpha_{1a}$ and $\alpha_{1b}$, respectively, with longitudinal axis 154 adjacent to first apex 148. Angles $\alpha_{1a}$ and $\alpha_{1b}$ are sized such that a regular reflection will occur on each side of first peak 146 when an incident supersonic flow, such as blast wave 145, moving in the direction of the longitudinal axis 154 contacts the side surfaces 150 and 152 near first apex 148. In the depicted embodiment, surfaces 150 and 152 are substantially symmetrical about the peak's longitudinal axis 154 (i.e., angles $\alpha_{1a}$ and $\alpha_{1b}$, are substantially the same), although this is not required.

Various values can be used for angles $\alpha_{1a}$ and $\alpha_{1b}$, as long as those angle values will cause a regular reflection to occur. For example, in a system that conforms to the values shown in FIG. 1, angles $\alpha_{1a}$ and $\alpha_{1b}$ can be any value that, in conjunction with the Mach number, falls within region 102. Other values may also be available depending on the type of system and propagating media. In some embodiments, either of angles $\alpha_{1a}$ and $\alpha_{1b}$ can be in a range between about 15 degrees to about 40 degrees, with about 15 degrees to about 30 degrees being common. In other embodiments, either of angles $\alpha_{1a}$ and $\alpha_{1b}$ can be less than about 40 degrees, less than about 30 degrees, or less than about 20 degrees. Other ranges are also possible.

In some embodiments, the combined angle between side surfaces 150 and 152 (i.e., $\alpha_{1a}+\alpha_{1b}$) can be less than about 80 degrees, less than about 60 degrees, or less than about 40 degrees. Other ranges of combined angles are also possible.

A second peak 156 is formed on outer surface 144 adjacent to first peak 146. Second peak 156, which is shorter than first peak 146, comprises two side surfaces 160 and 162 that both extend out to a second apex 158 on opposite sides of a longitudinal axis 164. In some embodiments, longitudinal axis 164 bisects the angle formed between side surfaces 160 and 162 at second apex 158. In some embodiments, longitudinal axis 164 is orthogonal to inner surface 142 of blast panel 140. In any event, longitudinal axis 164 is designed to be generally aligned with the propagation direction 147 of blast wave 145 when the portion of blast panel 140 that contains second peak 156 is "face on" to blast wave 145. In some embodiments, longitudinal axis 164 is generally parallel to longitudinal axis 154.

As depicted in the cross-sectional view of FIG. 5, the two side surfaces 160 and 162 are shaped so that the second peak 156 has a substantially triangular cross-section near second apex 158. Side surfaces 160 and 162 form angles $\alpha_{2a}$ and $\alpha_{2b}$, respectively, with longitudinal axis 164 adjacent to second apex 158.

In the depicted embodiment, surfaces 160 and 162 are substantially symmetrical about the peak's longitudinal axis 164 (i.e., angles $\alpha_{2a}$ and $\alpha_{2b}$, are substantially the same), although this is not required. Also, in some embodiments, a line drawn tangential to the slope of the shorter second peak 156 at apex 158 (see dashed line 166) does not intersect adjacent taller first peak 146. This helps to avoid reflected wave trappings, thus minimizing the pressure against the blast panel.

Unlike angles $\alpha_{1a}$ and $\alpha_{1b}$ of first peak 146, angles $\alpha_{2a}$ and $\alpha_{2b}$ are not constrained by the type of reflection they will cause to occur. That is, angles $\alpha_{2a}$ and $\alpha_{2b}$ can be sized such that a regular or Mach reflection or a combination thereof will occur on each side of second peak 156 when an incident supersonic flow, such as blast wave 145, moving in the direction of the longitudinal axis 164 contacts the side surfaces 160 and 162 near second apex 158. Thus, a wide range of values can be used for angles $\alpha_{2a}$ and $\alpha_{2b}$. For example, in a system that conforms to the values shown in FIG. 1, angles $\alpha_{2a}$ and $\alpha_{2b}$ can be any value that, in conjunction with the Mach number, falls within regions 102, 104, or 106. Other values may also be available depending on the type of system and propagating media. In some embodiments, either of angles $\alpha_{2a}$ and $\alpha_{2b}$ can be in a range between about 30 degrees to about 70 degrees, with about 40 degrees to about 60 degrees being common. In other embodiments, the combined angle between side surfaces 160 and 162 (i.e., $\alpha_{2a}+\alpha_{2b}$) can be less than about 70 degrees or more than about 30 degrees. Other ranges are also possible.

As shown in FIG. 5, side surface 150 of the first peak 146 and side surface 160 of the second peak 156 are continuously curved toward each other such that the side surfaces 150 and 160 come together to form a first valley 168. In the embodiment depicted, first valley 168 is substantially parabolic shaped between first peak 146 and second peak 156 for reasons that will be discussed below. Although the depicted valley 168 is substantially parabolic shaped, other curved shapes can also be used, as discussed below.

As noted above, first peak 146 is taller than second peak 156. That is, the distance $d_1$ between the bottom of the first valley 168 and apex 148 in the direction of longitudinal axis 154 is greater than the distance $d_2$ between the bottom of the first valley 168 and apex 158. As discussed below, the value of $d_1$ can be affected by whether transonic flow suppression is desired. Distance $d_1$, generally varies between about 0.5 microns to about 100 cm, with higher and lower values also possible. In some embodiments $d_1$ can vary between about 0.2 mm to about 50 mm, with about 1 mm to about 10 mm being common. In other embodiments, $d_1$ can vary between about 1 cm to about 100 cm, with about 1 cm to about 10 cm being common. In other embodiments, $d_1$ can be greater than about 0.3 mm, greater than about 1 mm, or greater than about 1 cm. Smaller values for $d_1$ can also be used for other embodiments, as discussed in more detail below.

As noted above, distance $d_2$ is less than $d_1$. In some embodiments, $d_1$ can be between about 2 and about 10 times greater than $d_2$, while in other embodiments $d_1$ can be between about 5 and about 10 times greater than $d_2$. In other embodiments, $d_1$ can be at least 2 times greater than $d_2$, at least 5 times greater than $d_2$, or at least 10 times greater than $d_2$. Other comparative sizes of $d_1$ and $d_2$ are also possible.

The distance between the first peak 146 and the second peak 156, represented by $d_4$ in FIG. 5, is generally in the same order of magnitude as the height, $d_1$, of the taller first peak 146. That is, the orthogonal distance $d_4$ between the longitudinal axis 154 of the first peak and the longitudinal axis 164 of the second peak 156 is in the same order of magnitude as $d_1$. As such, in some embodiments, $d_4$ generally varies between about 0.2 mm to about 50 mm, with about 1 mm to about 10 mm being common. In other embodiments, $d_4$ can vary between about 1 cm to about 100 cm, with about 1 cm to about 10 cm being common. In other embodiments, $d_4$ can be greater than about 0.3 mm, greater than about 1 mm, or greater than about 1 cm. Other sizes are also possible.

In some embodiments, $d_4$ can vary as a proportion of $d_1$. For example, in some embodiments, $d_4$ can be between about 0.5 to about 2 times the measurement of $d_1$, with about 0.5 to about 0.9 being common. In other embodiments, $d_4$ can be equal to or less than $d_1$; and in other embodiments substantially less than $d_1$. Other comparative sizes of $d_1$ and $d_4$ are also possible.

In some embodiments, a third peak 176 is formed on outer surface 144 adjacent to second peak 156. As shown in FIG. 5, third peak 176 is formed on the side of second peak 156 opposite first peak 146. Third peak 176, which is generally the same height as first peak 146, comprises two side surfaces 180 and 182 that both extend out to a third apex 178 on opposite sides of a longitudinal axis 184. In some embodiments, longitudinal axis 184 bisects the angle formed between side surfaces 180 and 182 at third apex 178. In some embodiments, longitudinal axis 184 is orthogonal to inner surface 142 of blast panel 140. In any event, longitudinal axis 184 is designed to be generally aligned with the propagation direction 147 of incident blast wave 145 when the portion of blast panel 140 that contains third peak 176 is "face on" to incident blast wave 145. In some embodiments, longitudinal axis 184 is generally parallel to longitudinal axes 154 and 164.

As depicted in the cross-sectional view of FIG. 5, the two side surfaces 180 and 182 are shaped so that the third peak 176 has a substantially triangular cross-section near third apex 178. Side surfaces 180 and 182 form angles $\alpha_{3a}$ and $\alpha_{3b}$, respectively, with longitudinal axis 184 adjacent to third apex 178. Similar to angles $\alpha_{1a}$ and $\alpha_{1b}$, angles $\alpha_{3a}$ and $\alpha_{3b}$ are sized such that a regular reflection will occur on each side of third peak 176 when an incident supersonic flow, such as blast wave 145, moving in the direction of the longitudinal axis 184 contacts the side surfaces 180 and 182 near third apex 178. In the depicted embodiment, surfaces 180 and 182 are substantially symmetrical about the peak's longitudinal axis 184 (i.e., angles $\alpha_{3a}$ and $\alpha_{3b}$, are substantially the same), although this is note required. Also, angles $\alpha_{3a}$ and $\alpha_{3b}$ can be substantially the same as angles $\alpha_{1a}$ and $\alpha_{1b}$ of first peak 146, although this is not required. Furthermore, similar to that described above, in some embodiments a line drawn tangential to the slope of the shorter second peak 156 at apex 158 (see dashed line 186) also does not intersect adjacent taller third peak 176. This helps to avoid reflected wave trappings, thus minimizing the pressure against the blast panel.

As with angles $\alpha_{1a}$ and $\alpha_{1b}$, various values can be used for angles $\alpha_{3a}$ and $\alpha_{3b}$, as long as those angle values will cause a regular reflection to occur. For example, in a system that conforms to the values shown in FIG. 1, angles $\alpha_{3a}$ and $\alpha_{3b}$ can be any value that, in conjunction with the Mach number, falls within region 102. Other values may also be available depending on the type of system and propagating media. For example, each of angles $\alpha_{3a}$ and $\alpha_{3b}$ can have any of the values discussed above regarding angles $\alpha_{1a}$ and $\alpha_{1b}$.

As shown in FIG. 5, side surface 180 of the third peak 176 and side surface 162 of the second peak 156 are continuously curved toward each other such that the side surfaces 180 and 162 come together to form a second valley 188. In the embodiment depicted, second valley 188 is essentially a mirror image of first valley 168, having a substantially parabolic shape between second peak 156 and third peak 176, with the bottoms of the valleys 168 and 188 being at about the same height above the inner surface 142. Although the depicted valley 188 is substantially parabolic shaped, other shapes can also be used. Furthermore, although second valley 188 is essentially a mirror image of first valley 168, this is also not required.

As noted above, third peak 176 is generally the same height as first peak 146. That is, the distance $d_3$ between the bottom of the second valley 188 and apex 178 in the direction of longitudinal axis 184 is generally the same as the distance $d_1$ between the bottom of the first valley 168 and apex 148. As such, distance $d_3$ can conform to the same ranges as discussed above regarding $d_1$. In some embodiments, third peak 176 is the same height as first peak 146 and has substantially the same attributes as first peak 146.

Similarly, the distance $d_5$ between second peak 156 and third peak 176 is generally the same as the distance $d_4$ between first peak 146 and second peak 156. That is, the orthogonal distance $d_5$ between longitudinal axis 164 of the second peak and the longitudinal axis 184 of the third peak 176 is generally the same as the distance $d_4$ between the longitudinal axis 154 of the first peak and the longitudinal axis 164 of the second peak 156. As such, distance $d_5$ can conform to the same general ranges as discussed above regarding $d_4$.

Figure 6:
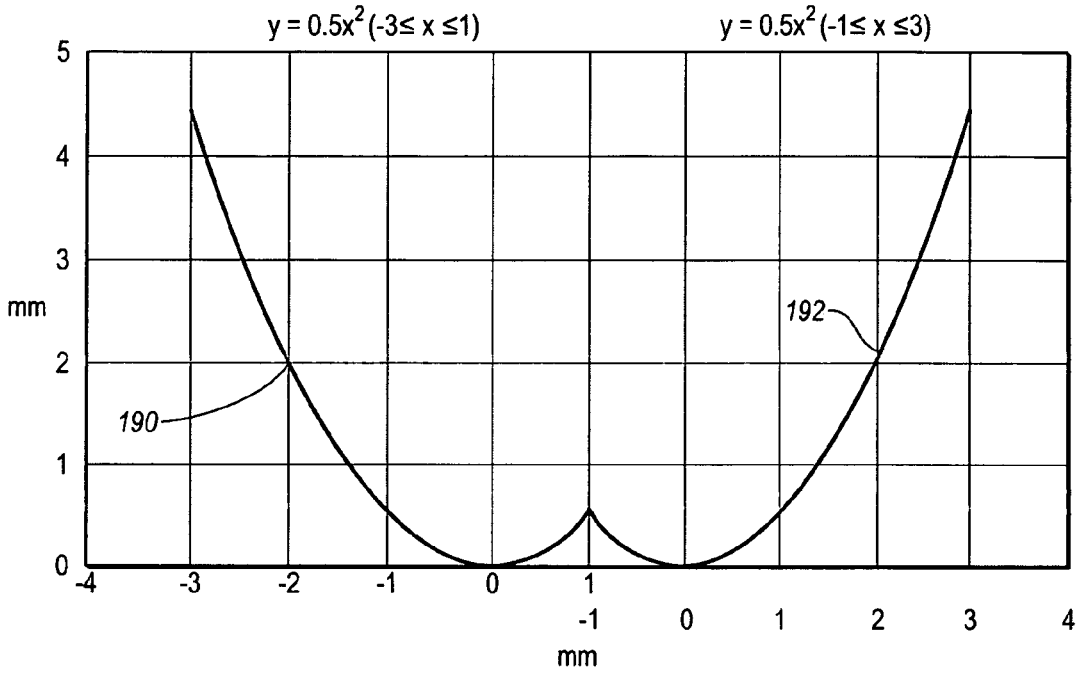
FIG. 6 is a view of a substantially parabolic profile that can be used with the blast panel shown in FIG. 5.

FIG. 6 shows one example of continuous curves 190 and 192 that can be used respectively for valleys 168 and 188. Curves 190 and 192 are substantially the same curve, but in mirror image of each other. The curves 190 and 192 are generally parabolic in nature, each having a general equation of $y=mx^2$, with curves 190 and 192 being offset from each other by $x_0$. In the depicted embodiment, x and y are measured in millimeters, m=0.5, and offset $x_0$=2 (i.e., the x-axis of curve 192 is shifted to the right from curve 190 by two millimeters). It is noted that curves 190 and 192 are exemplary only; other curves can alternatively be used. For example, in some embodiments m can range between about 0.4 to about 1, with about 0.5 to about 0.8 being common. In other embodiments, m is greater than about 0.4, or less than about 1. Furthermore, other offsets $x_0$ between curves 190 and 192 can alternatively be used. For example, in some embodiments $x_0$ can range between about 0.5 to about 4, with between about 1 and about 3 being common. Other values and ranges of values for m and $x_0$ can alternatively be used, and other equations can also be used. In addition, x and y (and, of course, $x_O$) can be measured in other units besides millimeters. For example, x, y, and, $x_0$ can alternatively be measured in micrometers, centimeters, inches, feet, or meters. Other dimensions can alternatively be used.

Blast panel 140 can be made of a variety of materials that can withstand the forces of a blast wave. For example, blast panel 140 can be made of metals (such as aluminum, titanium, steel, or alloys), plastics, ceramics, composites (such as fiber reinforced materials), rubber, and concrete. Other materials can also be used. In some embodiments, blast panel 140 is made from a material able to withstand a dynamic pressure of at least 0.1 MPa.

With the novel peaks and valleys construction described above, the blast panel 140 is able to better deflect and/or dissipate energy from the incoming incident blast wave and the subsequent transonic flow. As noted above in conjunction with FIG. 4, a Mach reflection occurs across the entire surface of a conventional flat blast panel when a blast wave encounters the blast panel generally face on, and this causes a great deal of force against the conventional blast panel. Instead of this increased force caused by the Mach reflection across the entire surface, the unique combination of high and low peaks of the inventive blast panel described above causes the Mach reflection to be minimized. For example, as discussed above, the taller peaks 146 and 176 are sized and shaped so that only regular reflections will occur thereat. As such, Mach reflections do not occur at these locations.

Figure 17A:
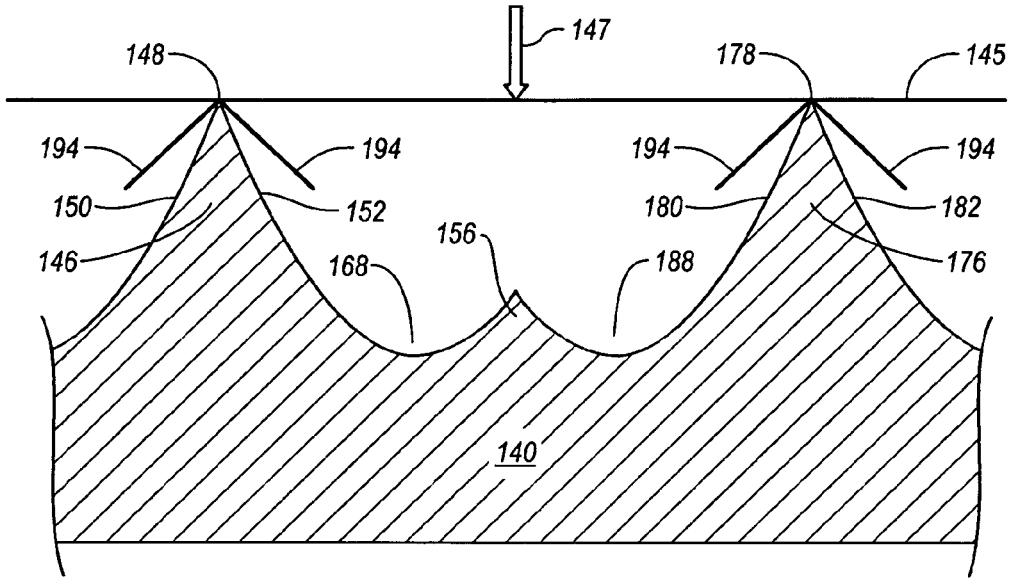
FIGS. 17*a*-17*d* are cross-sectional views showing what happens when an incident blast wave propagates toward the blast panel shown in FIG. 5.

Furthermore, as shown in FIGS. 17*a*-17*d*, although the shorter peak 156 and the valleys 168 and 188 are shaped so that Mach reflections are likely to occur thereat when facing a blast wave, the regular reflections from the taller peaks 146 and 176 also at least partially minimize those Mach reflections. In addition, the shorter peak 156 tends to help divide the Mach reflections into two smaller reflections. Turning to FIG. 17*a*, as incident blast wave 145 propagates toward blast panel 140 in the direction of arrow 147, the incident blast wave 145 first encounters peaks 146 and 176 because those peaks are taller than the rest of blast panel 140. As incident blast wave 145 contacts apexes 148 and 178, regular reflections occur thereat due to the measures of angles $\alpha_{1a}$, $\alpha_{1b}$, $\alpha_{3a}$, and $\alpha_{3b}$, as discussed above. These regular reflections cause shock waves 194 to be formed on side surfaces 150, 152, 180, and 182 of peaks 146 and 176. In some embodiments, the shorter peak 156 adjacent to the taller peaks 146 and 176 is positioned in such a manner that the shock waves 194 reflected from side surfaces 152 and 180 do not contact the peak 156. This helps to avoid the waves becoming trapped in the profile.

Figure 17B:
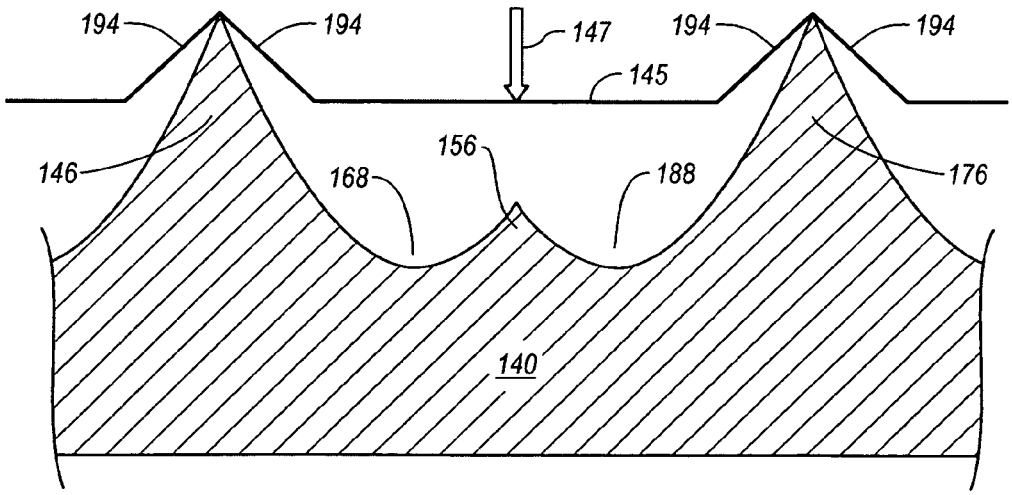

As shown in FIG. 17*b*, as the incident blast wave 145 propagates further towards the shorter peak 156 and valleys 168 and 188, the shock waves 194 formed on peaks 146 and 176 interact with the incident blast wave 145 so as to weaken the incident blast wave 145 somewhat.

Figure 17C:
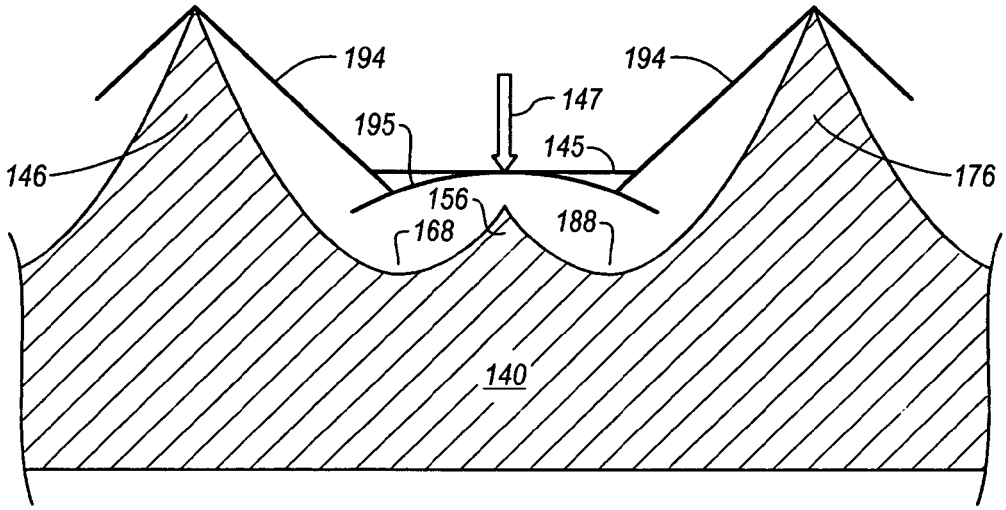

As shown in FIG. 17*c*, as the incident blast wave 145 propagates to a position closer to shorter peak 156, a Mach reflection begins to occur, causing a shock wave 195 to form above the shorter peak 156 and the valleys 168 and 188. However, due to the shock waves 194 caused by the regular reflections from taller peaks 146 and 176, the shock wave 195 caused by the Mach reflection is greatly diminished from what the shock wave 195 would normally be if taller peaks 146 and 176 were not present on either side of shorter peak 156. In other words, the regular reflections of the incident blast wave from the taller peaks 146 and 176 interact with the incident blast wave 145 to at least partially suppress the amount of Mach reflection that occurs. That is, while a Mach reflection may still occur over the valleys 168, 188 and shorter peak 156 due to the trapped incident blast wave 145, the Mach reflection is significantly weakened by the reflections from the taller peaks 146 and 176. Furthermore, the shorter peak 156 further diminishes the intensity of the Mach reflection by causing the Mach reflection to essentially be divided into two separate Mach reflections, one above each valley. Accordingly, because the Mach reflection is diminished, much less force is transferred to blast plate 140 due to Mach reflection. And because, as noted above, Mach reflection causes a much higher force against a blast plate than a regular reflection, the total force transferred to blast plate 140 due to the blast wave is greatly diminished.

As noted above, a transonic flow typically follows the incident blast wave to cause a secondary force against the blast panel. When the shock wave propagates at high Mach speeds, such as above 1.5, the transonic flow can generate close to 0.6 bars of pressure or higher against the blast panel, which can add to damage incurred as a result of the blast wave. The curved shapes of side surfaces 152, 160, 162, 180 that form valleys 168 and 188 of blast panel 140 help to alleviate this problem.

Figure 17D:
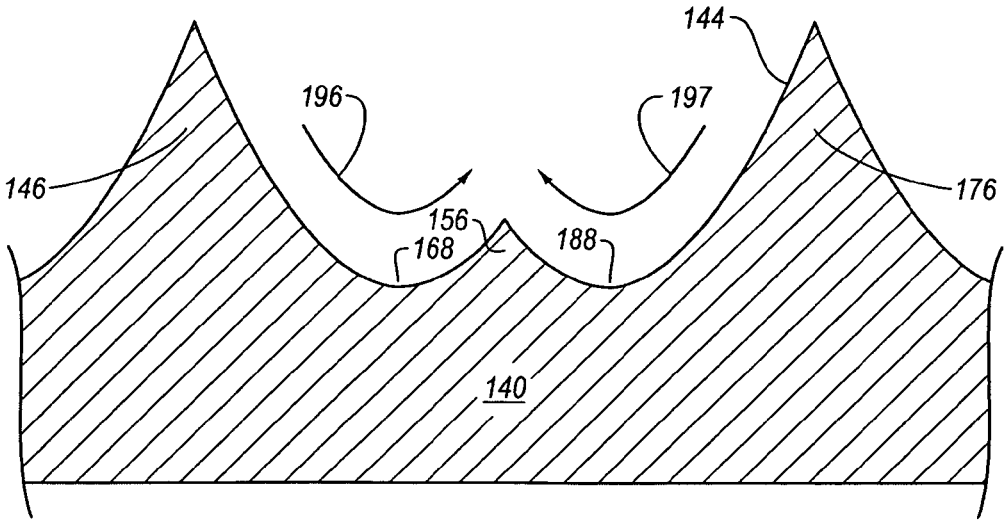

For example, as shown in FIG. 17*d*, after the incident blast wave, the subsequent transonic flows 196 and 197 are deflected by the parabolic shaped valleys 168 and 188 back toward the direction from which the transonic flows came and toward each other. In so doing, the transonic flows from adjacent higher peaks 146 and 176 collapse on each other, thereby generating quasi-stable eddies above the valleys 168 and 188 and/or the shorter peak 156. These eddies store and dissipate frictional energy caused by the supersonic and transonic flows. Some of the energy stored in these eddies feeds back to the surface 144, causing some residual pressure on the blast panel 140. However, the residual pressure is spread out over time and is therefore more easily handled and dissipated. Because the residual pressure is spread out over time, the blast panel does not have to withstand the pressure all at once. The instantaneous force at any one time is less than the initial incident force by the ratio of eddy dwell time to the initial flow duration.

Transonic flow suppression can impose size limitations. For example, to obtain a high efficiency, the size of the profile elements should not be less than the thickness of the boundary layer. For a typical transonic flow, the boundary layer is approximately 0.2 to 0.3 mm. As such, an efficient profile should be at least that tall. That is, the distances $d_1$ and $d_3$ between the bottom of the valleys 168 and 188 and the apexes 148 and 178 of the highest peaks 146 and 176 (see FIG. 5) should be at least 0.2 to 0.3 mm for the embodiments having parabolic shaped valleys if transonic flow suppression is desired. Of course, if transonic flow suppression is not a concern, the profile can be much smaller, as described below.

Figure 7:
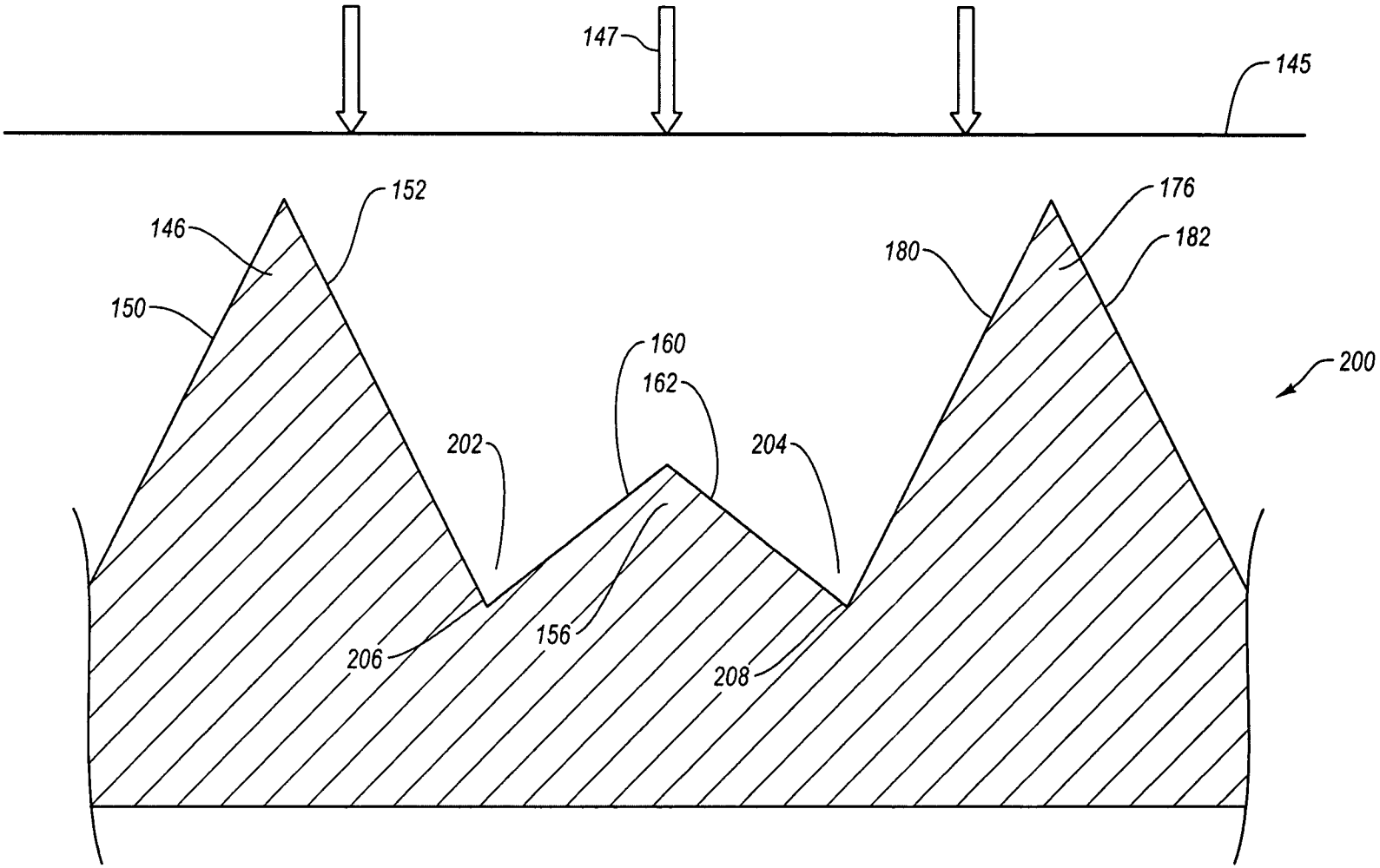
FIG. 7 is a cross-sectional view of a portion of a blast panel according to an embodiment of the present invention in which the valleys are substantially v-shaped.

In many cases, the suppression of the transonic flow associated with a blast wave is not a concern. For example, thick reinforced concrete structures or poles are typically strong enough to ignore transonic flow pressure contributions. In these cases, the valleys between the peaks can be formed without curved surfaces, thus making manufacturing easier. For example, FIG. 7 depicts a portion of a surface profile of a blast panel 200 according to one embodiment of the present invention in which the valleys are not curved. Similar structure between blast panel 200 and blast panel 140 are identified by like element numbers.

As noted above, blast panel 200 is similar to blast panel 140 except that instead of first and second valleys 168 and 188 being continuously curved, blast panel 200 has first and second valleys 202 and 204 that are substantially v-shaped. In this embodiment, side surfaces 150, 152, 160, 162, 180, and 182 are all substantially linear. Side surfaces 152 of first peak 146 and 160 of second peak 156 come together to form a first vertex 206 at the bottom of the first valley 202, and side surfaces 162 of second peak 146 and 180 of third peak 176 come together to form a second vertex 208 at the bottom of the second valley 204. Although side surfaces 150, 152, 160, 162, 180, and 182 are depicted as being substantially straight, other non-linear shapes can also be used. For example, side surfaces 150, 152, 160, 162, 180, and 182 can have multiple angles or can have a combination of straight and curved sections. Other shapes are also possible.

Although part of the flow may become trapped in the valleys, blast panels having v-shaped, valleys offer some advantages over blast panels with curved valleys if suppression of the transonic flow is not a concern. For example, manufacturing of blast panels having v-shaped valleys may be easier and cheaper than the manufacture of blast panels having curved surfaces. Tolerances for the v-shaped surfaces can typically be much more forgiving than with the parabolic or other curved surfaces, especially when using concrete and the like.

Furthermore, the profile of the blast panel surface can be much smaller. As noted above, to have a high efficiency when attempting to suppress the transonic flow, the thickness of the boundary layer of the flow is a limiting factor, requiring the height of the tall peaks to be at least 0.2 to 0.3 mm. However, if transonic flow suppression is not a concern, the main limiting factor for efficiency is the thickness of the shock wave front which is much thinner than the boundary layer. At M=1, a shock wave front in air has a thickness of about 0.05 microns. The thickness is even smaller at higher Mach numbers. Therefore, if transonic flow suppression is not a concern, a micron-size profile can be efficient, which is about a thousand times smaller than the profile required for high efficiency of the blast panel attempting to suppress transonic flow. As such, $d_1$ can have other values and ranges of values than those discussed above if transonic flow is not an issue. For example, in some embodiments distance $d_1$ can vary between about 0.1 micron to about 100 microns with about 1 to about 10 microns or about 1 to about 5 microns being common. In some embodiments, $d_1$ can be less than about 1 micron, less than about 10 microns or greater than about 0.5 microns. Other values for $d_1$ are also possible.

Figure 8:
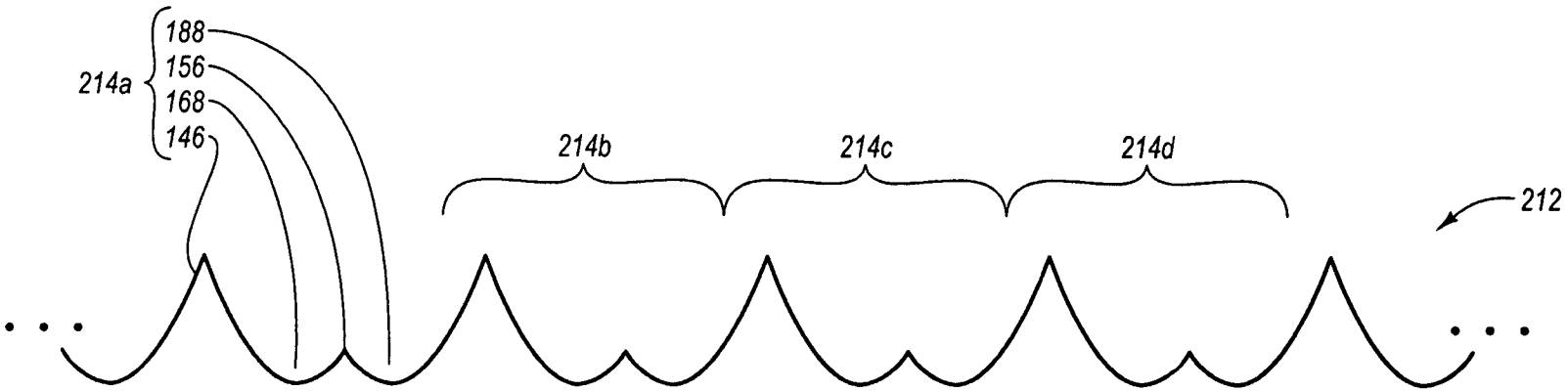
FIG. 8 depicts a surface profile of a blast panel having repeating peak structures according to an embodiment of the present invention.

In some embodiments, the tall and short peaks are included in a repeating pattern of peak structures, with each peak structure including a taller peak and a shorter peak positioned with respect to each other as discussed above. For example, FIG. 8 depicts the surface profile of one embodiment of a blast panel 212 having a plurality of peak structures 214 that each contains a first peak 146 and a second peak 156, with a first valley 168 formed therebetween, as discussed above. A second valley 188 is also formed between the shorter peak 156 and another first peak 146 of an adjacent peak structure 214, as also discussed above. This pattern of peak structures 214 can be repeated across the entire blast panel 212, if desired. Although the valleys in FIG. 8 are curved, it is appreciated that v-shaped valleys, such as valleys 202 and 204, discussed above, can also be used in peak structures 214.

Figure 9:
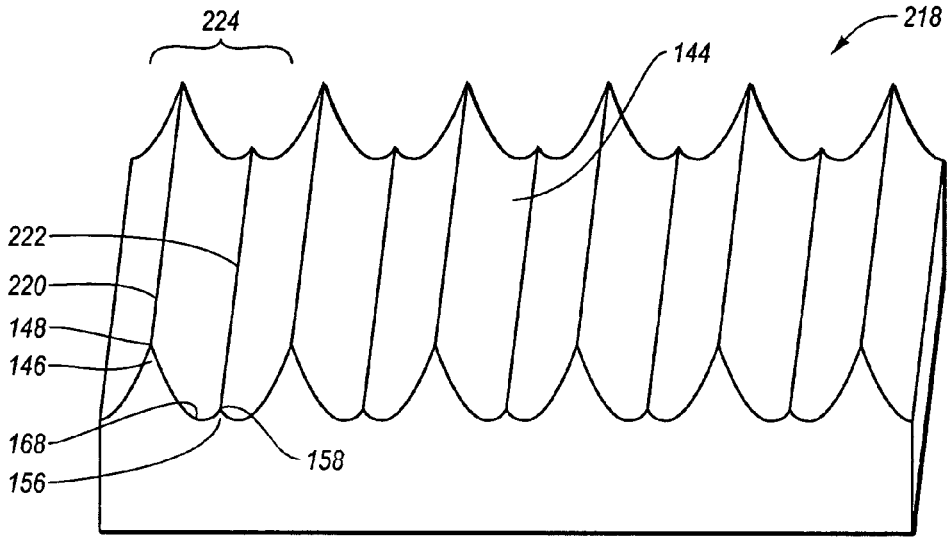
FIG. 9 is a perspective view of a blast panel having the repeating surface profile shown in FIG. 8.
Figure 10:
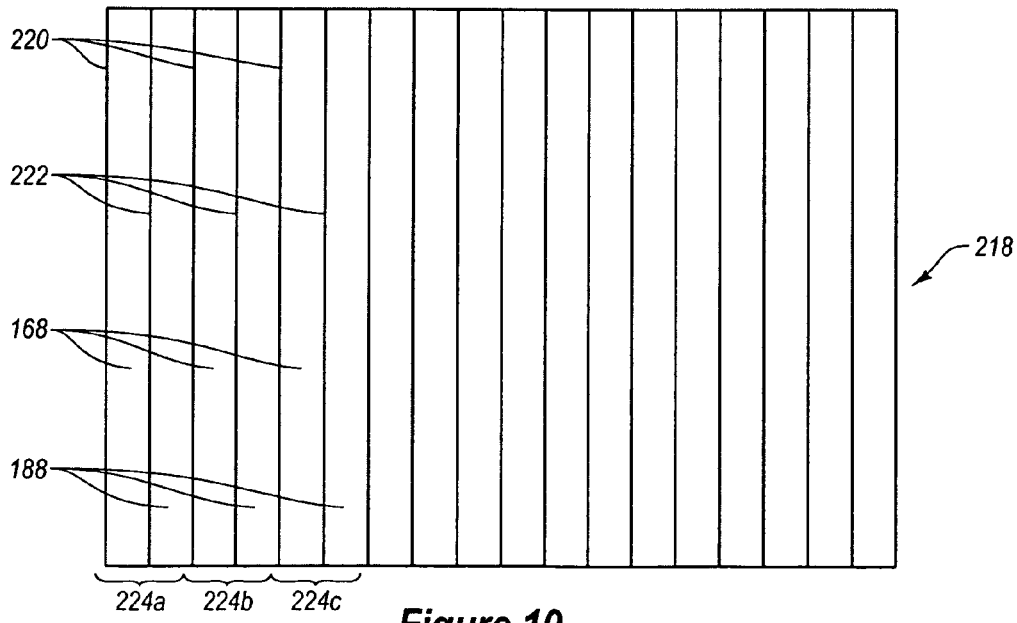
FIGS. 10-12 are top plan views of blast panels having various patterns of ridges, peaks, and valleys according to various embodiments of the present invention.

Furthermore, each of the peaks 146 and 156 can be linearly formed on the outer surface 144 of the blast panel. For example, FIG. 9 shows a blast panel 218 in which each of the peaks 146 and 156 extends laterally over at least a portion of the armor plating surface 144 so that the first apex 148 forms a first ridge 220 disposed at the first distance $d_1$ above the first valley 168 and the second apex 158 forms a second ridge 222 disposed at the second distance $d_2$ above the first valley 168. In the depicted embodiment, the first ridge 220 and the second ridge 222 are substantially parallel to each other. It is also appreciated that first and second ridges 220, 222 can be included in a repeating pattern of ridge structures 224, similar to that discussed above, and as shown in the top view of FIG. 10. Forming the ridges in a linear fashion across the surface 144 allows for simple manufacturing, as the blast panel can then be made, for example, by extrusion of plastics or aluminum or alloys and applied to large surfaces.

Figure 11:
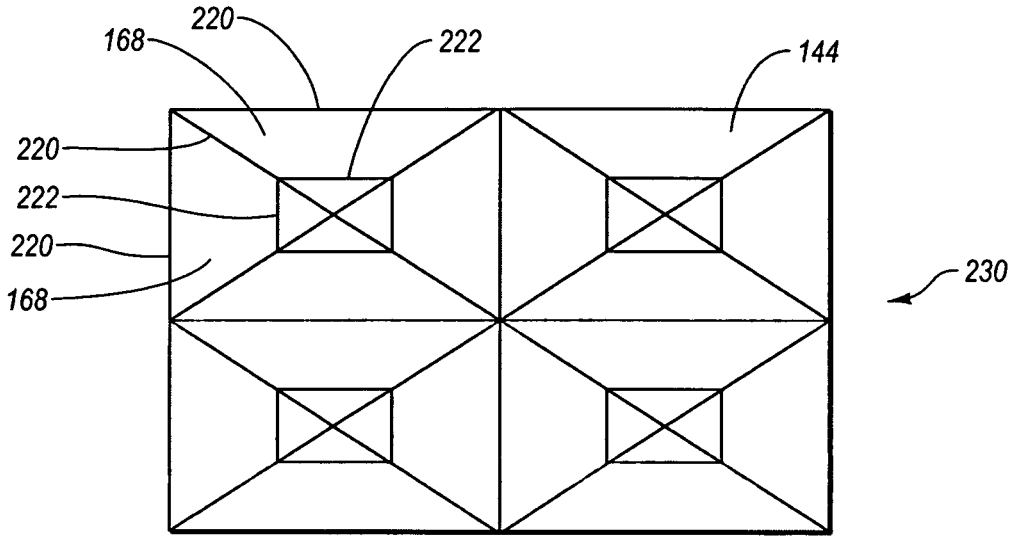
Figure 12:
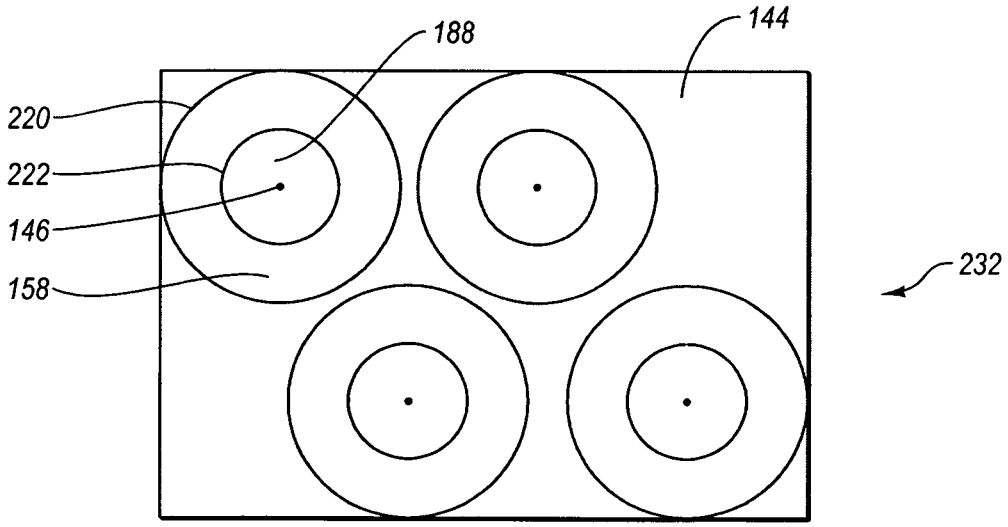

It is also appreciated that the ridges, peaks and valleys can be arranged so as to form other linear and non-linear geometric patterns on the armor plating surface 144. For example, FIGS. 11 and 12 are top views of blast panels 230 and 232, respectively, in which the ridges 220 and 222 form repeating patterns. In FIG. 11, ridges 220 and 222 form repeating rectangular and triangular patterns with valleys 168 being formed between the ridges. In FIG. 12, ridges 220 and 222 are laterally curved to form repeating circular patterns with valleys 168 and 188 between the ridges. Note that in blast panel 232 of FIG. 12, peaks 146 are formed at the center of the encircling ridges 200 and 202 and are substantially cone shaped. Other geometrical shapes can also be formed by peaks 168, 188 and/or ridges 220, 222, such as symmetrical or non-symmetrical polygons, ovals, or other symmetrical or non-symmetrical shapes. Although FIGS. 11 and 12 show repeating patterns, in other embodiments, the geometric patterns are not repeating. In some embodiments, both repeating and non-repeating patterns are used. In some embodiments the blast panel can include various differing shapes. And of course, as noted above, the valleys between the peaks in the depicted embodiments can be curved or v-shaped or form some other shape.

Although the blast panel having non-linear ridges can be somewhat harder to manufacture, aesthetics or other reasons may dictate using such a structure.

Figure 13A:
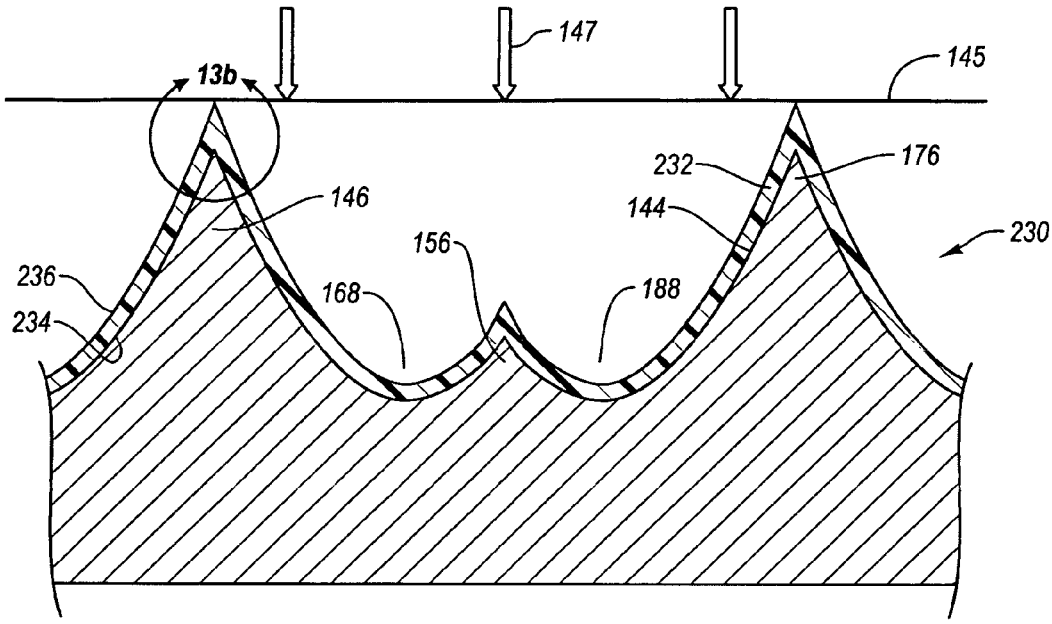
FIG. 13*a*-13*b* are cross-sectional views of a blast panel having a deformable layer according to an embodiment of the present invention.

In some embodiments, the blast panel includes a thin deformable or compressible layer positioned next to the outer surface of the blast panel so as to follow the contours of the peaks and valleys. For example, FIG. 13*a* shows a blast panel 230 with a separate thin deformable layer 232 that is positioned adjacent to outer surface 144 so as to follow the contours of peaks 146, 156, 176, and valleys 168, 188. Deformable layer 232 comprises an inside surface 234 and an opposing outside surface 236. Layer 232 is positioned so that the inside surface 234 is adjacent to the outer surface 144 and the outside surface 236 faces the blast wave 145. Deformable layer 232 can be in the form of a sheet that is placed on blast panel 230. For example, deformable layer 232 can comprise a corrugated material, such as metal or plastic or the like, or can be a non-corrugated deformable material, such as rubber, plastic, polymers or the like. Furthermore, the inside surface 234 of the deformable layer 232 can be welded or glued to the outer surface 144. Alternatively, deformable layer 232 can comprise a material that is sprayed on or otherwise coated onto outer surface 144. For example, deformable layer 232 can comprise a spray-on rubber, plastic, acrylic, or the like. Other materials are also possible and other attachment methods can also be used.

Deformable layer 232 needs to be thin enough to be able to conform to and keep the same general shape as the profile of outer surface 144. In some embodiments, deformable layer 232 has a thickness that can vary between about 10 microns to about 100 microns, with about 20 microns to about 50 microns being common. In other embodiments, deformable layer 232 has a thickness that is less than about 50 microns, less than about 20 microns, or less than about 10 microns. For larger peaks and valleys, deformable layer 232 can have a thickness up to about 5 cm or up to about 1 cm.

Figure 13B:
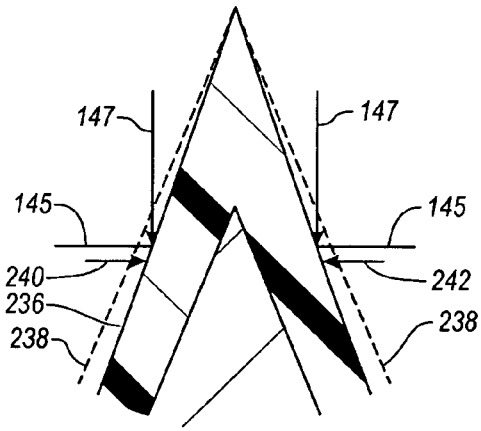

Using a deformable layer can yield additional benefits to the blast panel. For example, as shown in FIG. 13*b*, which is a close-up of the portion of FIG. 13*a* denoted by "13*b*," when the blast wave 145 comes into contact with the outside surface 236 of deformable layer 232, the layer 232 compresses. As shown in FIG. 13*b*, blast wave 145 causes layer 232 to compress from its original position, denoted by dashed line 238, at least partially laterally towards the side surfaces of the peaks (i.e., in the direction of arrows 240 and 242). This compression, in effect, squeezes the peaks and thereby dissipates part of the energy.

Figure 14:
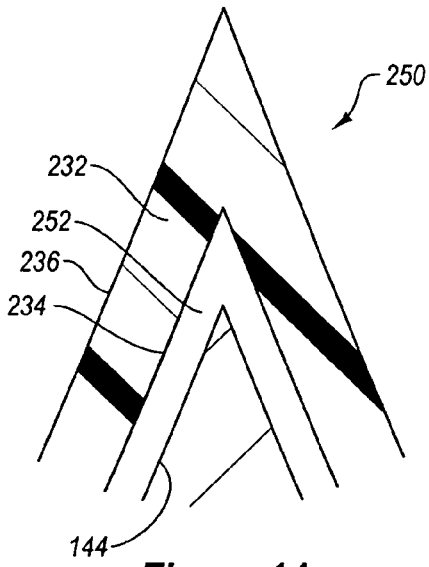
FIG. 14 is a cross-sectional view of a portion of another blast panel having a deformable layer according to an embodiment of the present invention.

FIG. 14 shows a close up of a portion of another alternative embodiment of a blast panel 250, in which the deformable layer 232 is separated from the outer surface 144. Because of this separation, inside surface 234 of layer 232 and outer surface 144 bound a space 252 therebetween. This allows layer 232 to laterally deform further into the space, thus helping to dissipate more energy from the blast wave. In addition, space 252 can be filled with an energy absorbing material to further help dissipate the energy from the blast wave. For example, sand, gravel, elastomers or the like can be used to fill space 252. Other materials can also be used to fill space 252.

In some embodiments, space 252 has a thickness that can vary between about 10 microns to about 100 microns, with about 20 microns to about 50 microns being common. In other embodiments, space 252 has a thickness that is less than about 50 microns, less than about 20 microns, or less than about 10 microns. For larger peaks and valleys, space 252 can have a thickness up to about 5 cm or up to about 1 cm.

Figure 15:
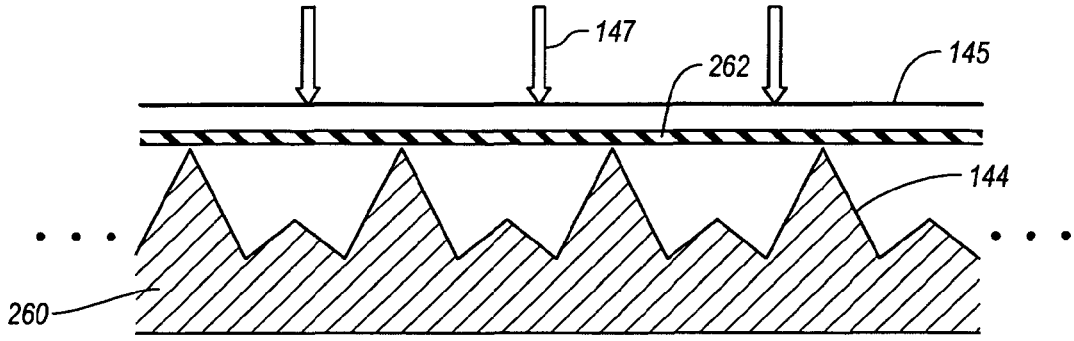
FIG. 15 is a cross-sectional view of a blast panel having a covering according to an embodiment of the present invention.

In many cases it is desired that the blast panel profile be protected from the elements. For example, mud or other debris can coat the profile or get stuck within the valleys. Furthermore, in many cases protection is desired against the sharp edges of the peaks of the profile, such as on wearable armor or a helmet. For these and other reasons, in some embodiments the blast panel includes a covering positioned over the blast panel. For example, FIG. 15 shows a blast panel 260 with a covering 262 positioned over the surface 144 so as to cover all of the peaks and valleys. Note that instead of following the contours of the peaks and valleys like deformable layer 232 discussed previously, covering 262 is substantially planar or extends in a smooth contour over the entire surface 144. Furthermore, while deformable layer 232 is configured to compress when it is contacted by the blast wave 145, covering 262 is configured to allow the blast wave 145 to pass therethrough, absorbing little if any of the blast wave energy. To allow for this, covering 262 is comprised of a material that will allow the blast wave 145 to pass therethrough. For example, covering 262 can comprise a stretchable or otherwise deformable sheet of fabric or elastomer or thin rubber material. A plastic or metal mesh can alternatively be used. Other materials can also be used. While allowing blast wave 145 to pass through, covering 262 protects the profile from the elements and protects people from the sharp edges of the profile.

Of course it is noted that while each of the particular embodiments of blast panels described above may show either only curved valleys or only V-shaped valleys, this is by no means meant to limit the scope of the invention. That is, any of the embodiments described above could use either type of valley depending on the desire of the user. Furthermore, if so desired by the user, both types of valleys can be incorporated into the same blast panel.

Figure 18A:
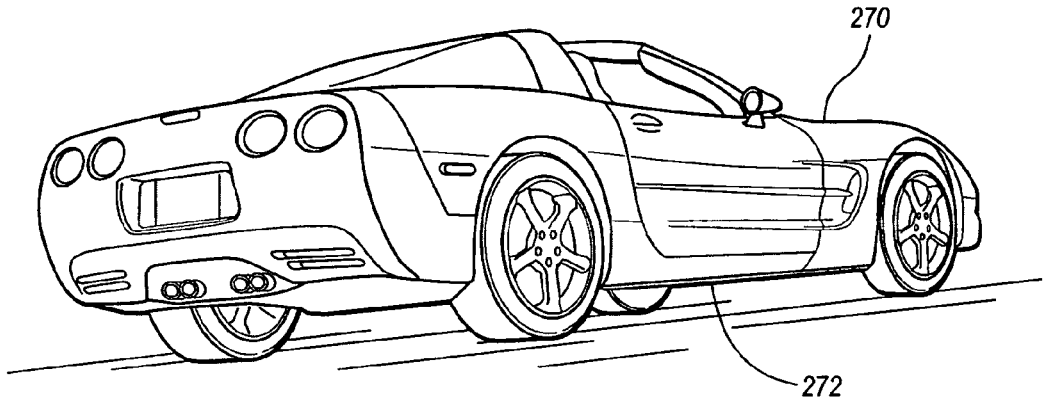
FIGS. 18*a*-18*g* depict various types of structures having inventive blast panels attached thereto or integrated therewith.
Figure 18B:
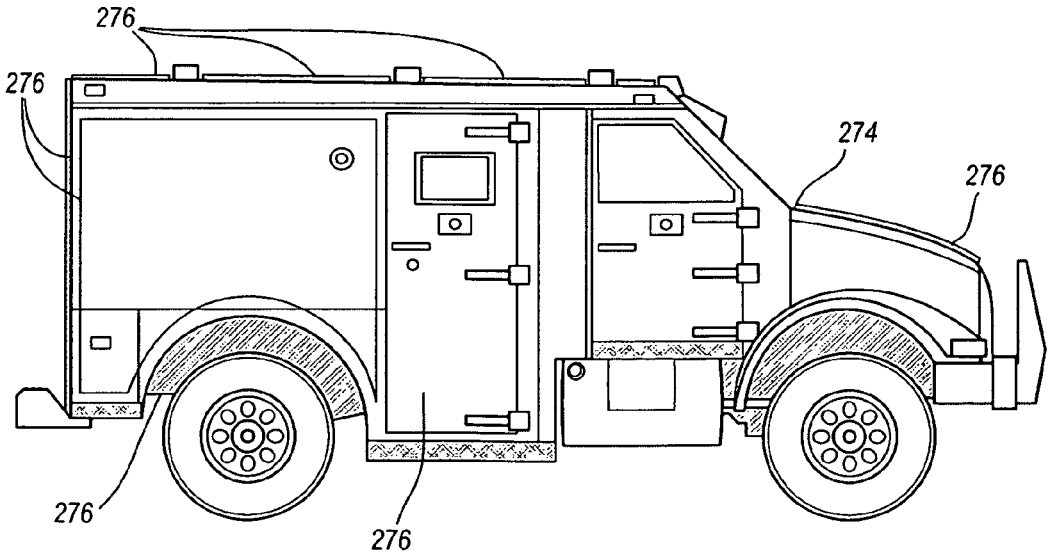

The various embodiments of blast panels described herein can be attached to or integrated with many different types of structures, such as those shown, for example, in FIGS. 18*a* through 18*g*. For example, FIG. 18*a* shows a motor vehicle 270 comprising a main body 272 that houses an engine and a drive train (not shown) that are used to rotate one or more wheels 274 to propel the motor vehicle on a road or other surface. The main body 272 also has an underside 276 designed to face the road or other surface. An inventive blast panel 278, which can include any of the embodiments discussed previously, is attached to or integrally formed with the underside 276 of the main body 272. It is appreciated that blast panels according to the present invention can be used with any type of motor vehicle, such as, for example, an automobile, a limousine, a truck, a jeep, an armored vehicle, or a military vehicle. Other vehicles can also be used. It is also appreciated that any combination of the surfaces can be covered. For example, FIG. 18*b* shows an armored car 280 with inventive blast panels 282 disposed on the roof, the door panels, the hood, and the underside of the vehicle. Applicant notes that the blast panels 276 can comprise a single panel disposed on or integrated with all or a portion of the entire surface or multiple smaller panels adjacent with one another disposed on or integrated with the surface.

Figure 18C:
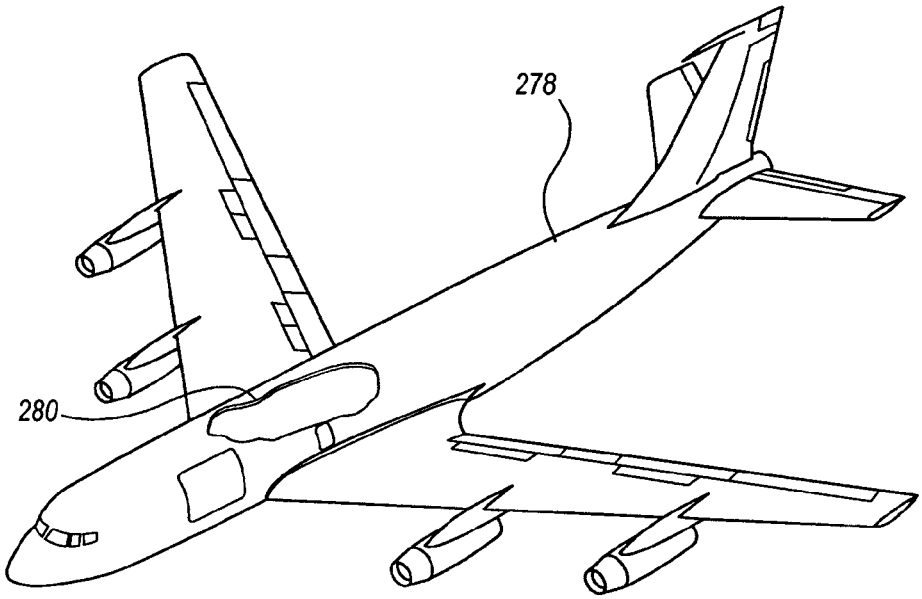

FIG. 18*c* shows an aircraft 284 comprising an airframe 286 onto which one or more engines are mounted. The airframe 286 typically includes a fuselage 288 having wings 290 and a tail section 292 extending therefrom. The airframe 286 has an inner surface 294 designed to face the interior of the airframe 286, and an opposing outer surface 296 designed to face the exterior of the aircraft. An inventive blast panel 298 is incorporated on at least a portion of the inner surface 294 of the aircraft to protect the aircraft structure against a bomb or other explosive device that is detonated on the inside of the aircraft, for example by terrorists. Of course, it is appreciated that one or more inventive blast panels can also be incorporated on the outer surface 296 of the aircraft.

Figure 18D:
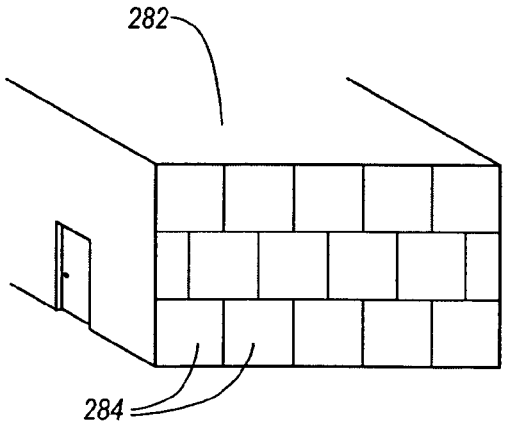

FIG. 18*d* shows a building structure 300 having an exterior wall 302. The exterior wall 302 has an outer surface 304 configured to face away from the interior of the building structure 300. A plurality of inventive blast panels 306 are disposed on or integrated with the outer surface 304 of the exterior wall 302. The blast panels 306 are disposed side by side and the rows are offset from adjacent rows although this is not necessary. Of course, instead of multiple blast panels 306, a single blast panel covering the outer surface 304 can alternatively be used. Inventive blast panels can also be used with other structures, such as towers, bunkers, walls, and the like.

Figure 18E:
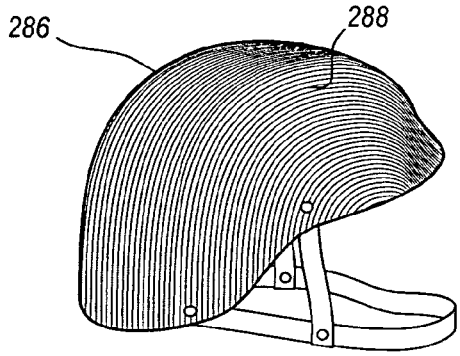
Figure 18F:
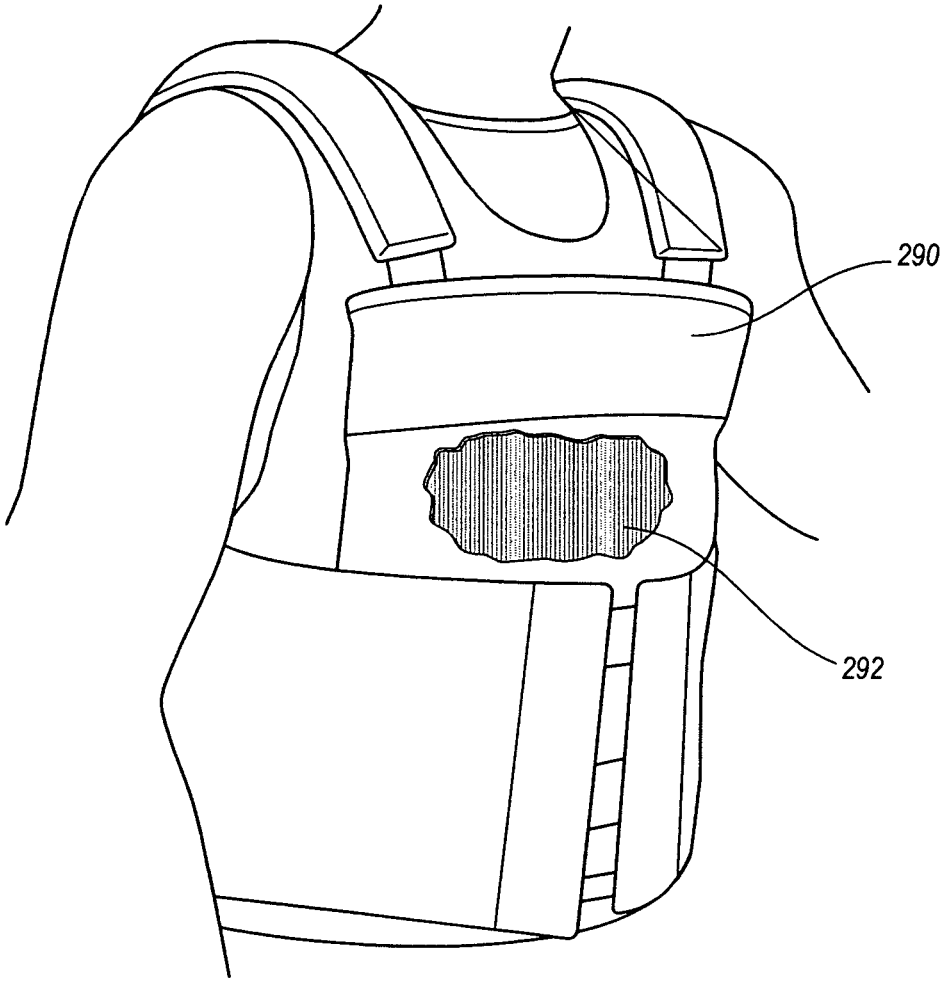
Figure 18G:
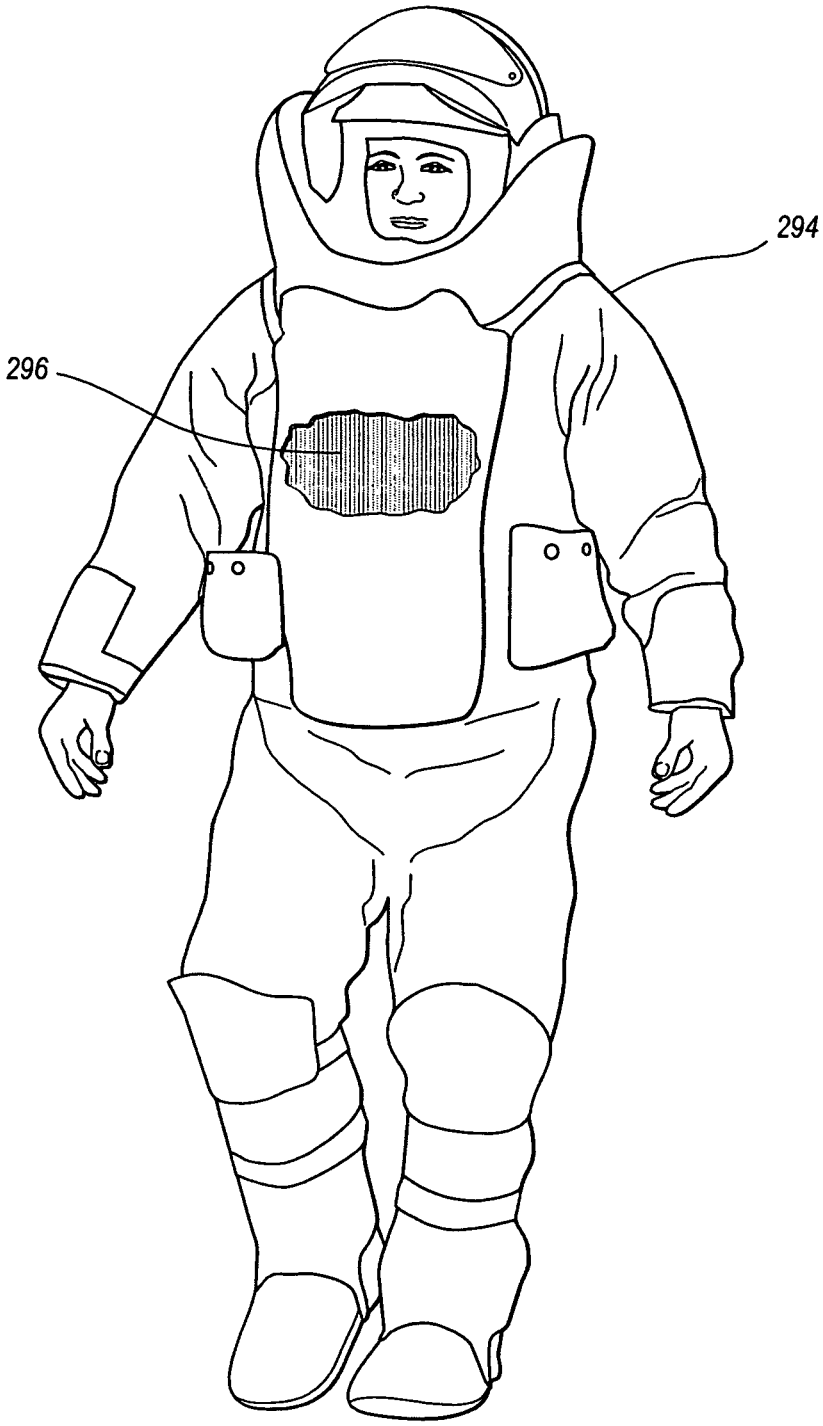

FIG. 18*e* through *g* show various articles that can be worn that include an inventive blast panel incorporated thereon. FIG. 18*e* shows a helmet 308 comprising a protective shell 310 having an interior surface 312 and opposing exterior surface 314. An inventive blast panel 316 is attached to or integrally formed with the exterior surface 314 of the protective shell 310. Note that the blast panel 316 is curved so as to follow the curved contour of the protective shell 310. FIG. 18*f* shows wearable body armor 318 comprising a protective garment 320 configured to be worn by a user. An inventive blast panel 322 is disposed on or within the protective garment 320. FIG. 18*g* shows an explosive ordnance disposal suit 324 comprising a protective suit 326 configured to be worn by a user. An inventive blast panel 328 is disposed on or within the protective suit 326. As noted above, any of the blast panels discussed herein can be covered with a covering to protect the blast panel or to prevent injury. The body armor and explosive ordnance disposal suit respectively shown in FIGS. 18*f* and 18*g* incorporate such a covering 330, although this is not necessary. The inventive blast panel can also be used in or on other types of objects, such as engine linings, as well as any other structure for which protection against a supersonic blast wave is desired.

Testing has confirmed the reduction in force felt by a structure that uses the inventive profiled blast panel. In one test, panels made from 7075 aluminum alloy plates were machined with profiled parabolic mills so as to have the surface profile shown in FIG. 6. The profiled test panels were 6 inches long and 6 inches wide. The calculated optimum shock wave velocity for the profiled panels was approximately M=3, with a calculated operating range from M=1 to M=5.5. The taller peaks 146 had a height $d_1$ of 4.5 mm and the lower peaks 156 had a height $d_2$ of 0.5 mm, with the valleys 168 and 188 being substantially parabolic shaped. Flat non-profiled panels with the same area and mass as the test panels were also fashioned from the same type of alloy for comparative purposes.

Both sets of panels were tested concurrently in each test to determine the difference in force felt by each type of panel due to an explosive blast. For each test, the profiled and non-profiled panels were mounted side-by-side on identical ballistic pendulums with accelerometers so that the panels would be facing the blast wave, and the ballistic pendulums were disposed behind the panels to measure the force from the blast wave. The ballistic pendulums weighed 2.7 kg, which can be thought to represent part of the mass of a typical man's head, and the panel area corresponded to the normal projection of roughly the same part of the head. The test measurements were taken in the open field at a distance of four meters from the blasts. Tests were performed using different masses of explosive charges. Electric detonators with 5 ms delay were used to detonate explosive charges of composition C-4 with masses of 2, 3.75 and 5 kg. The charges were positioned 1.2 m above the ground. The charges had a cylindrical shape and were oriented with the cylinder axis vertical relative to the ground. Panels on the ballistic pendulums were also positioned approximately 1.2 m above the ground, assuring that any interference from the blast wave reflected from the ground could be easily differentiated. Accelerometer data was recorded at 1 Ms/s with 25-50 ms of data obtained and stored for each test.

Figure 16:
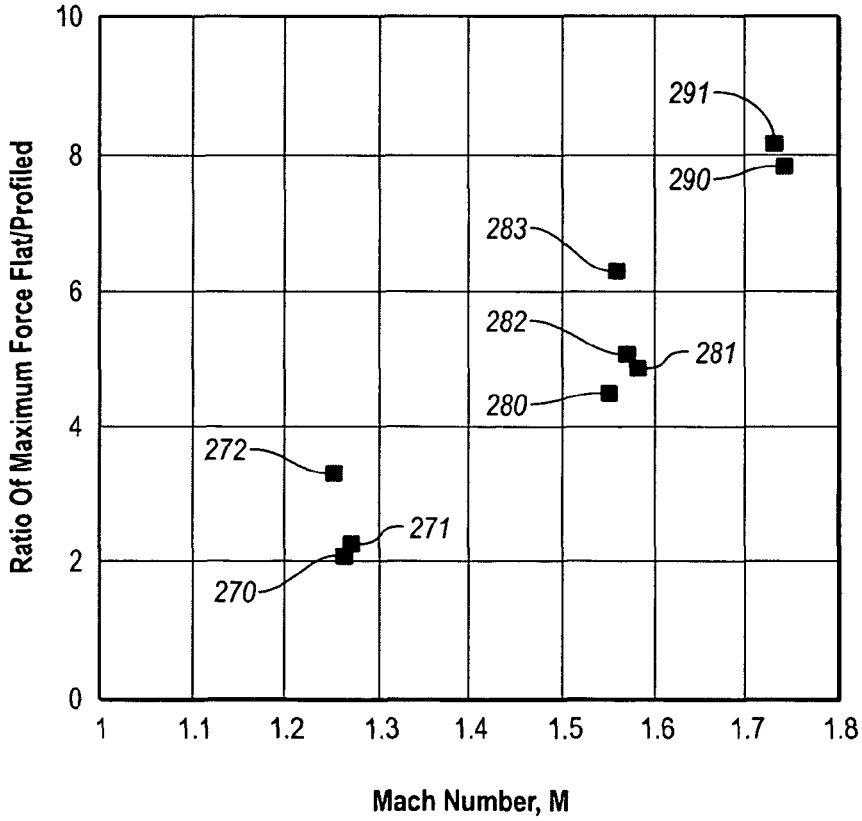
FIG. 16 is a graph generated using test data obtained during testing of the inventive blast panels showing the ratio of maximum force on a blank panel to maximum force on a profiled panel as a function of the blast wave Mach number.

Using the data obtained from each test, the ratio of the maximum force on the blank panel to the maximum force on the profiled panel was determined as a function of the shock wave Mach number, and is shown in FIG. 16. In FIG. 16, the x-axis of the graph represents the velocity of the blast wave as measured in the test, and the y-axis represents the ratio of the maximum force on the blank panel to the maximum force on the profiled panel. In other words, the y-axis shows how much the maximum force against the panels was reduced by the profiled panel relative to the corresponding non-profiled panel. For example a reading of "4" on the y-axis means that the force measured behind the profiled blast panel was four times less than (i.e., ¼ of) the force measured behind the corresponding non-profiled blast panel. It is noted that a ratio above 1 (i.e., any portion of the graph in which the y-axis is greater than 1) signifies that the inventive profiled panel showed a reduction in maximum force compared to the non-profiled panel.

Each data point in FIG. 16 represents a separate blast test, wherein a profiled and a non-profiled panel were concurrently used: data points 270-272 represent tests using the C-4 having a mass of 2 kg.; data points 280-283 represent tests using the C-4 having a mass of 3.75 kg.; and data points 290-291 represent tests using the C-4 having a mass of 5 kg.

As shown in FIG. 16, the maximum force felt by the test equipment protected by the inventive profiled panels was in every case significantly less than the maximum force felt by the test equipment protected by the non-profiled panels. In fact, the ratio obtained in the tests ranged from a low of about 2 to a high of about 8. This means that the maximum force felt by the test equipment protected by the inventive profiled panels was less than the test equipment protected by the non-profiled panels by between 2 and 8 times. In other words, only ½ to ⅛ of the maximum blast wave energy felt behind the non-profiled panels was felt by the test equipment protected by the profiled panel. This signifies that the rest of the blast wave energy, between ½ to ⅞ of it, was successfully dissipated or deflected by the inventive profiled panels. This is quite significant.

Extrapolating from FIG. 16, we can also see that the panel performance improved (i.e., the ratio was higher) for the inventive panels as the Mach number of the blast wave went up. That is, a higher percentage of blast wave energy was dissipated or deflected at the higher Mach numbers using the inventive blast panel profile. This is also significant, as more damage would be expected at higher Mach numbers and thus more dissipation and/or deflection would be beneficial. Extrapolating further, it is not unreasonable to assume that an even higher percentage of blast wave energy would be dissipated or deflected at even higher Mach numbers using the inventive blast panel profiles.

It is appreciated that the tests described above were performed using nearly ideal profile shapes at particular Mach numbers. As noted above, the profile can be adjusted to any shock wave front velocities, corresponding to a variety of expected threats. Within the scope of this invention the profile can be used as is, or somewhat simplified for easier manufacturability. While non-ideal shapes may not yield the same spectacular results, they will still be able to provide a substantial increase of protection over conventional blast panels.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A system for reducing the effects of a blast wave, the system comprising:

armor plating having a surface configured to face a supersonic blast wave propagating toward the armor plating, the armor plating surface being openly exposed to the external environment and comprising:

a first peak comprising a first side surface extending outward to a first apex;

a second peak adjacent to the first peak, the second peak comprising a second side surface extending outward to a second apex; the first side surface and the second side surface combining to form a first valley between the first peak and the second peak, the first apex being disposed at a first distance above the first valley and the second apex being disposed at a second distance above the first valley, the first distance being at least five times greater than the second distance, wherein the first peak, the second peak, and the first valley are configured such that the supersonic blast wave reflects from the first side surface as a regular reflection that at least partially suppresses Mach reflection of the supersonic wave caused by the second peak and the first valley.

2. The system recited in claim 1, wherein the first and second side surfaces are shaped such that a smooth transition occurs therebetween so that the first valley has a substantially parabolic shape.

3. The system recited in claim 1, wherein the first and second peaks have substantially triangular transverse cross sections and the first valley is substantially v-shaped.

4. The system recited in claim 1, wherein the first distance is at least ten times greater than the second distance.

5. The system recited in claim 1, wherein the first peak extends laterally over at least a portion of the armor plating surface so that the first apex forms a first ridge disposed at the first distance above the first valley and wherein the second peak extends laterally over at least a portion of the armor plating surface so that the second apex forms a second ridge disposed at the second distance above the first valley, the first ridge and the second ridge being substantially parallel to each other.

6. The system recited in claim 1, wherein the armor plating surface further comprises:

a third peak adjacent to the second peak, the third peak comprising a third side surface extending outward to a third apex that is disposed at a third distance above the first valley, the second peak being disposed between the first peak and the third peak, the third distance being greater than the second distance; and the second peak also having a fourth side surface extending outward to the second apex, the third side surface and the fourth side surface combining to form a second valley between the second peak and the third peak, wherein the second peak, the third peak, and the second valley are configured such that the supersonic blast wave reflects from the third side surface as a regular reflection that at least partially suppresses Mach reflection of the supersonic wave caused by the second peak and the second valley.

7. The system recited in claim 6, wherein the third distance is substantially the same as the first distance.

8. The system recited in claim 6, wherein an imaginary line drawn tangential to the second side surface at the second apex does not intersect the third side surface of the third peak.

9. The system of claim 1, wherein the first peak, the second peak, and the first valley are formed from one or more of the following materials: metal, plastic, ceramic, composite, rubber, and concrete.

10. The system of claim 1, wherein the first peak, the second peak, and the first valley are formed from a material that can withstand a dynamic pressure of at least 0.1 MPa.

11. The system recited in claim 1, wherein the second peak has the second side surface and an opposing first side surface that intersect at the second apex, the first side surface and the second side surface of the second peak each having a concave curvature along the length thereof, the second peak being symmetrical.

12. A system for reducing the effects of a blast wave, the system comprising:

armor plating having a surface configured to face a supersonic blast wave propagating toward the armor plating, the armor plating surface comprising:

a first peak comprising first and second side surfaces each extending outward to a first apex on opposite sides of a first longitudinal axis that bisects the first peak, the second side surface forming an angle $\alpha_1$ with the first longitudinal axis adjacent to the first apex that is less than 30 degrees;

a second peak adjacent to the first peak, the second peak comprising third and fourth side surfaces each extending outward to a second apex on opposite sides of a second longitudinal axis that bisects the second peak, the third side surface forming an angle $\alpha_2$ with the second longitudinal axis adjacent to the second apex, the second side surface of the first peak and the third side surface of the second peak combining to form a first valley between the first peak and the second peak; and a third peak adjacent to the second peak such that the second peak is positioned between the first and third peaks, the third peak comprising fifth and sixth side surfaces each extending outward to a third apex on opposite sides of a third longitudinal axis that bisects the third peak, the fifth side surface forming an angle $\alpha_3$ with the third longitudinal axis adjacent to the third apex that is less than 30 degrees, the fourth side surface of the second peak and the fifth side surface of the third peak combining to form a second valley between the second peak and the third peak;

wherein the first and third apexes are disposed at a first distance above the first valley that is between about 1 mm and about 10 mm, and the second apex is disposed at a second distance above the first valley, such that the first distance is at least 5 times greater than the second distance.

13. The system recited in claim 12, wherein the first, second, and third longitudinal axes are substantially parallel to each other.

14. The system recited in claim 12, wherein the first and second valleys are substantially v-shaped.

15. The system recited in claim 12, wherein the first and second valleys are substantially parabolic shaped.

16. The system recited in claim 15, wherein the parabolic shape is defined by the general equation $y=mx^2$, wherein x represents the lateral distance of the surface from a bottom of the respective valley, m represents a parabolic coefficient, and y represents a distance of the surface above the bottom of the respective valley at lateral distance x.

17. The system recited in claim 12, wherein the first distance is between about 5 and about 10 times greater than the second distance.

18. The system recited in claim 12, wherein the angles $\alpha_1$ and $\alpha_3$ are each less than about 20 degrees.

19. The system recited in claim 12, wherein the peaks and valleys form ridges and valleys that extend across the surface of the armor plating.

20. The system recited in claim 12, wherein the first and second peaks and the first and second valleys form a peak structure, and the system comprises a plurality of peak structures positioned side by side such that the second valley of one peak structure is adjacent to the first peak of an adjoining peak structure.

21. The system of claim 12, wherein the armor plating surface is formed from one or more of the following materials: metal, plastic, ceramic, composite, rubber, and concrete.

22. The system of claim 12, wherein the armor plating surface is formed from a material that can withstand a dynamic pressure of at least 0.1 MPa.

* * * * *